US006706469B2

(12) United States Patent
Takada

(10) Patent No.: US 6,706,469 B2
(45) Date of Patent: Mar. 16, 2004

(54) SILVER HALIDE EMULSION, SILVER HALIDE COLOR PHOTOGRAPHIC LIGHT-SENSITIVE MATERIAL AND IMAGE-FORMING METHOD

(75) Inventor: Katsuyuki Takada, Minami-ashigara (JP)

(73) Assignee: Fuji Photo Film Co., Ltd., Kanagawa-Ken (JP)

( * ) Notice: Subject to any disclaimer, the term of this patent is extended or adjusted under 35 U.S.C. 154(b) by 32 days.

(21) Appl. No.: 09/819,604

(22) Filed: Mar. 29, 2001

(65) Prior Publication Data

US 2002/0045139 A1 Apr. 18, 2002

(30) Foreign Application Priority Data

Mar. 29, 2000 (JP) ..... 2000-092084

(51) Int. Cl.[7] ..... G03C 1/035

(52) U.S. Cl. ..... 430/569; 430/567; 430/374; 430/376

(58) Field of Search ..... 430/567, 569, 430/374, 376

(56) References Cited

U.S. PATENT DOCUMENTS

| | | | | |
|---|---|---|---|---|
| 4,400,463 A | | 8/1983 | Maskasky | 430/434 |
| 5,176,991 A | | 1/1993 | Jones et al. | 430/569 |
| 5,176,992 A | | 1/1993 | Maskasky et al. | 430/569 |
| 5,185,239 A | | 2/1993 | Maskasky | 430/569 |
| 5,217,858 A | * | 6/1993 | Maskasky | 430/567 |
| 5,219,720 A | * | 6/1993 | Black et al. | 430/567 |
| 5,420,005 A | * | 5/1995 | Saitou | 430/567 |
| 5,494,788 A | * | 2/1996 | Chang et al. | 430/567 |
| H1609 H | * | 11/1996 | Kondo | 430/567 |
| 5,587,280 A | * | 12/1996 | Ikeda et al. | 430/567 |
| 5,698,379 A | * | 12/1997 | Bohan et al. | 430/359 |
| 5,906,914 A | * | 5/1999 | Taguchi et al. | 430/567 |
| 5,998,105 A | * | 12/1999 | Murakoshi | 430/375 |
| 6,395,464 B1 | * | 5/2002 | Suzuki et al. | 430/567 |

FOREIGN PATENT DOCUMENTS

| | | | |
|---|---|---|---|
| JP | 6-308644 | 11/1994 | G03C/1/035 |
| JP | 9-197594 | 7/1997 | G03C/1/035 |

OTHER PUBLICATIONS

Research Disclosure, 308119, Dec., 1989.*

* cited by examiner

*Primary Examiner*—Rosemary Ashton
*Assistant Examiner*—Amanda C. Walke
(74) *Attorney, Agent, or Firm*—Sughrue Mion, PLLC

(57) ABSTRACT

A silver halide emulsion which comprises silver halide grains having a silver chloride content of at least 90 mole %, wherein tabular grains satisfying the following conditions (1) and (2) account for at least 70% of the total projected area of all the silver halide grains present: (1) the grain has {111} major faces, an aspect ratio of 2 or more and a thickness of 0.30 $\mu$m or less; and (2) a ratio (b/a) of the grain thickness (b) to the longest distance (a) between at least two parallel twin planes of the tabular grain is in the following range:

$$1.5 \leqq (b/a) < 5.$$

22 Claims, No Drawings

SILVER HALIDE EMULSION, SILVER HALIDE COLOR PHOTOGRAPHIC LIGHT-SENSITIVE MATERIAL AND IMAGE-FORMING METHOD

FIELD OF THE INVENTION

The present invention relates to a silver halide emulsion, a silver halide color photographic light-sensitive material, and a color image-forming method, both of which latter two use said silver halide emulsion. In particular, the present invention relates to a silver halide emulsion containing high silver chloride tabular grains having {111} major faces, a silver halide color photographic light-sensitive material, and a color image-forming method, both of which latter two use said silver halide emulsion.

BACKGROUND OF THE INVENTION

It is well known that color photography is a process of forming dye images, achieved by subjecting a light-sensitive material, comprising a support, having thereon dye-forming couplers and a silver halide emulsion, to a color development processing with an aromatic primary amine color-developing agent, resulting in the formation of an oxidation product of the developing agent, followed by a reaction of the oxidation product and the dye-forming coupler (hereinafter referred to as a coupler).

Nowadays, such silver halide color photographic light-sensitive materials are extensively used, because they are highly sensitive and excellent in gradation. Recently, however, demands for photographic properties, such as further enhancement of photographic speed, processing stability, image quality, and development processing speed, have become stronger than ever. Therefore, various studies are carried out. As to advances in processing speed, light-sensitive materials using silver halide grains having a high silver chloride content (a silver chloride content of 90 mole % or more is referred to as high silver chloride) have become mainly used, from the viewpoint of rapid color development, particularly in a color photographic printing paper. For example, International Patent Publication WO 87/04534 discloses that a high silver chloride emulsion is preferably used as a photographic emulsion. However, it is also known that, if the silver chloride content of the silver halide emulsion to be used is increased, developing speed is greatly improved, but, on the other hand, silver chloride emulsions have a disadvantage that generally they exhibit low sensitivity. Accordingly, overcoming this disadvantage is a task to be solved in order to put a high silver chloride emulsion to practical use.

Further, the stability to a processing solution is enumerated as one of important properties which are required for a color photographic printing paper. Generally, a high silver chloride emulsion raises the problem that, as the silver chloride content increases, silver halide grains are easily dissolved into a processing solution. In a practical color development processing as an example, a light-sensitive material passes through successive baths that include a developing solution, a fixing/bleaching solution, and a washing solution, in this order. It is known that, if a bleach-fixing solution is mixed in a developing solution in the foregoing processing steps, dissolution of the grains is accelerated, and dissolution physical development advances, so that an image obtained by the development processing exhibits higher sensitivity and higher contrast, thereby causing a fluctuation of the gradation, compared with the sensitivity and contrast obtained by a normal processing, in which mixing of the bleach-fixing solution in the developing solution does not occur. Such a situation is rare but occurs at a definite frequency. Further, it is known that activities of the developing solution change due to a difference between frequencies in the use of running processing. Consequently there is a problem that a difference in activities of the developing solution changes photographic properties.

As to the foregoing problem, when dissolution of grains occurs more easily, a greater change in photographic properties due to the difference in activities of the developing solution is likely to occur. It is considered important, from the viewpoint of providing a highly reliable color photographic printing paper, that an image of definite quality is regularly formed, even by the foregoing development processing in which impurities are mixed, or when some degree of change in activities of the developing solution arise. Further, in fact, demand for improvement of the above-mentioned processing stability is also strong in the market, and improvement in the toughness of development processing steps using a high silver chloride emulsion is desired. Herein, the expression "an image of definite quality" used herein refers to an image obtained without fogging, sensitization, and fluctuation of gradation, due to the above-mentioned change of the processing solution.

When tabular silver halide emulsion grains are employed in a photographic light-sensitive material, generally the proportion by which rays of light incident upon a light-sensitive layer, pass through the light-sensitive layer, is lower, and the capture efficiency of light increases, and moreover enhancement of photographic speed (sensitivity) can be achieved, in comparison with non-tabular silver halide emulsion grains. It is known that tabular silver halide grains therefore can be made smaller than non-tabular grains, resulting in improved image quality (covering power, sharpness, granularity), development progress characteristics, spectral sensitization characteristics, and the like.

On the other hand, it was found that, when tabular grains are compared to non-tabular grains having a photographic speed equivalent thereto, the tabular grains cause a more serious problem in solubility, since they have a larger ratio of surface area to volume. U.S. Pat. No. 5,543,281 discloses that a certain type of phenylmercaptotetrazole derivatives is effective in preventing grains from being dissolved. However, these compounds were insufficient to solve the foregoing problem.

As a result of studies aimed at solving the problems of sensitization and fluctuation of gradation due to mixing of a bleach-fixing solution in a developing solution, the present inventor has found that it is useful in solution of the problems to control the ratio (b/a) of grain thickness (b) to the distance (a) between parallel twin planes of the tabular grains, so that the ratio (b/a) would be less than 5, and further preferably to increase the degree of monodispersion of the ratio (b/a).

JP-A-6-308644 ("JP-A" means unexamined published Japanese patent application) describes a method of producing tabular grains, which comprises controlling the distance between twin planes and the ratio of the thickness of tabular grains to the distance between twin planes. However, this patent publication relates to a method of producing high silver bromide {111} tabular grains, and there is no mention of high silver chloride grains.

In order to produce high silver chloride {111} tabular grains, a special measure is needed. For example, U.S. Pat.

Nos. 4,400,463, 5,185,239, and 5,176,991, JP-A-63-213836, U.S. Pat. Nos. 5,176,992, and 5,691,128, disclose a method of forming grains in the presence of a crystal habit-controlling agent, such as aminoazaindene, triaminopyrimidine, hydroxylaminoazine, thiourea, xanthonoid, or a pyridinium salt, respectively. JP-A-9-197594 discloses a method of producing tabular grains having a ratio (b/a) of grain thickness (b) to the distance (a) between twin planes of 5 or more. Thus, generally, as the silver chloride content increases, a {111} plane is predominantly formed on the outermost surface. Consequently, when high silver chloride {111} tabular grains are formed, the grains are apt to grow in the thickness direction (b), and to ordinarily exhibit a ratio (b/a) of 5 or more.

SUMMARY OF THE INVENTION

The present invention is a silver halide emulsion which comprises silver halide grains having a silver chloride content of at least 90 mole %, wherein tabular grains satisfying the following conditions ① and ② account for at least 70% of the total projected area of all the silver halide grains present:

① the grain has {111} major faces, an aspect ratio of 2 or more, and a thickness of 0.30 μm or less, and ② a ratio (b/a) of the grain thickness (b) to the longest distance (a) between at least two parallel twin planes of the tabular grain is in the following range:

$$1.5 \leqq (b/a) < 5.$$

Further, the present invention is a silver halide color photographic light-sensitive material which comprises at least one silver halide emulsion layer that contains the said silver halide emulsion.

Further, the present invention is a method of forming a color image which comprises:

① subjecting the said silver halide color photographic light-sensitive material to scanning-exposure with a light beam modulated based on an image information, and ② subjecting the exposed light-sensitive material to photoprocessing.

Still further, the present invention is a method of forming a color image which comprises processing the said silver halide color photographic light-sensitive material in a color-development processing time of 20 sec or less.

Other and further features and advantages of the invention will appear more fully from the following description.

DETAILED DESCRIPTION OF THE INVENTION

According to the present invention, there are provided the following means:

(1) A silver halide emulsion comprising silver halide grains having a silver chloride content of at least 90 mole %, wherein tabular grains satisfying the following conditions ① and ② account for at least 70% of the total projected area of all the silver halide grains present:

① the grain has {111} major faces, an aspect ratio of 2 or more, and a thickness of 0.30 μm or less, and ② a ratio (b/a) of the grain thickness (b) to the longest distance (a) between at least two parallel twin planes of the tabular grain is in the following range;

$$1.5 \leqq (b/a) < 5$$

(2) The silver halide emulsion according to the above (1), wherein the silver halide grains have a silver iodide content of 0.05 to 1.0 mole %;

(3) The silver halide emulsion according to the above (1) or (2), wherein the silver halide grains have a silver bromide content of 0.05 to 5.0 mole %;

(4) A silver halide color photographic light-sensitive material comprising at least one silver halide emulsion layer which contains the silver halide emulsion according to the above (1), (2) or (3);

(5) A method of forming a color image comprising

① subjecting the silver halide color photographic light-sensitive material of the above (4) to scanning-exposure with a light beam modulated based on an image information, and ② subjecting the exposed light-sensitive material to photoprocessing; and (6) A method of forming a color image comprising processing the silver halide color photographic light-sensitive material of the above (4) in a color-development processing time of 20 sec or less.

The silver halide emulsion of the present invention will be explained below.

The silver halide emulsion of the present invention is composed of silver chloride, silver chlorobromide, silver chloroiodide, or silver chloroiodobromide, each having a silver chloride content of 90 mole % or more. The silver chloride content preferably ranges from 90 to 99.9 mole %, more preferably from 95 to 99.9 mole %. The silver iodide content preferably ranges from 0.05 to 1.0 mole %, more preferably from 0.05 to 0.8 mole %. The silver bromide content preferably ranges from 0.05 to 5.0 mole %, more preferably from 0.1 to 2.0 mole %.

It is preferable that silver halide grains for use in the emulsion of the present invention have a so-called core/shell structure which is composed of a core portion and a shell portion surrounding the core portion. The core portion preferably has a silver chloride content of 90 mole % or more. The core portion may be composed of at least two sub portions having a different halogen composition from each other. The shell portion preferably accounts for 50% or less (preferably 50 to 0.1%), and especially preferably 40% or less (preferably 40 to 0.1%), of the total grain volume.

The shell portion is preferably composed of silver iodochloride, or silver iodochlorobromide. The iodide content of the shell portion preferably ranges from 0.5 mole % to 10 mole %, especially preferably from 0.5 mole % to 5 mole %. The silver bromide content of the shell portion may range from 0.05 mole % to 100 mole %, but it is preferred that the shell portion has a bromide-rich layer of preferably at least 10 mole %, more preferably at least 30 mole %. It is preferable that both the silver iodide content and the silver bromide content are higher in the shell portion than the core portion.

In the emulsion of the present invention, it is preferred that {111} major face tabular silver halide grains account for 90 to 100%, more preferably 95 to 100% of the total projected area of all the silver halide grains present in the emulsion.

Among these grains, tabular silver halide grains which meet the limitations of the aspect ratio, the grain thickness and the ratio of (b/a) each defined in the present invention, account for 70 to 100%, preferably 80 to 100%, and more preferably 90 to 100% of the total projected area of all the silver halide grains present in the emulsion.

The term "tabular silver halide grains" (hereinafter referred to as "tabular grains") used herein, means the grains having two facing parallel major faces and an aspect ratio of at least 2. The term "aspect ratio" used herein refers to the value of the diameter of a circle having an area equivalent to the projected area of a grain, divided by the thickness (b) of the grain. The larger the aspect ratio is, the more the grains become flat, resulting in a tabular shape. In the present invention, the average aspect ratio preferably ranges from 2.0 to 100, more preferably from 3.0 to 100, furthermore preferably from 4.0 to 100. The term "average aspect ratio" used herein refers to the average value of aspect ratios of all the tabular grains present in the emulsion. The term "projection diameter of a tabular grain" refers to the diameter of a circle having an area equivalent to the projected area measured by a method in which a major face is placed in parallel onto the surface of a substrate to observe it from a perpendicular direction. In the present invention, "equivalent circle diameter" or "equivalent projected area diameter" is used in the same meaning as the "projection diameter". The equivalent circle diameter of a tabular grain for use in the present invention preferably ranges from 0.1 to 10 $\mu$m, more preferably from 0.2 to 5.0 $\mu$m, especially preferably from 0.2 to 2.0 $\mu$m.

Further, the term "thickness (b) of a grain" refers to the distance between two major faces of an individual tabular grain. In the present invention, the thickness preferably ranges from 0.01 to 0.30 $\mu$m, more preferably from 0.02 to 0.30 $\mu$m, especially preferably from 0.05 to 0.25 $\mu$m. The thickness (b) of the grain can be easily measured by a method, in which a metal is vapor-deposited on the slant of the grain as well as a latex for reference, and the length of the resultant shadow is measured on an electron microscopic photograph, to calculate the thickness with reference to the length of shadow of the latex.

In the present invention, the grains in which the ratio (b/a) of the grain thickness (b) to the longest distance (a) between at least two parallel twin planes of the tabular grain (hereinafter referred to as "twin plane interval (a)") is in the following range: $1.5 \leqq (b/a) < 5$, account for 70% or more (more preferably 80 to 100%) of the total grain projected area. Further, the term "average (b/a)" used herein refers to the average value of (b/a) of all the tabular grains. The average (b/a) is preferably in the following range: $1.5 \leqq$ average (b/a)<5, more preferably in the following range: $1.7 \leqq$ average (b/a)<5.

The term "twin plane interval (a)" refers to the distance between two twin planes with respect to the grains having two twin planes therein, and to the longest distance among distances among three or more twin planes with respect to the grains having three or more twin planes.

The term "twin plane" refers to a {1,1,1} plane in the case where ions of all lattice points have a relationship of mirror image at the both sides of the {1,1,1} plane. The twin plane interval can be observed by means of a transmission type electron microscopy. Specifically, observation and measurement can be carried out as follows.

An emulsion containing tabular grains is coated on a support to prepare a sample in which the tabular grains are placed at almost parallel onto the support. The sample thus prepared is cut to a slice having a thickness of about 0.1 $\mu$m by means of a diamond knife.

The resulting slice is observed by means of a transmission type electron microscope, to thereby investigate the structure of a section at the perpendicular direction to the major face of the tabular grain. At that time, when electron beams pass through the twin planes, a phase gap arises in an electron wave. As a result, the presence of the twin planes is realized. A sectional structure of the tabular grain is photographed by means of a transmission type electron microscope. The ratio (b/a) can be obtained by measuring a ratio of the distance between major faces and the distance between the twin planes.

Further, the coefficient of variation of the thickness (b) of the grains is preferably 30% or less, and more preferably in the range of 20% to 0%. The coefficient of variation of the twin plane interval (a) is preferably 30% or less, and more preferably in the range of 20% to 0%. The coefficient of variation of the ratio (b/a) is preferably in the range of 30% to 0%.

The term "coefficient of variation of the thickness (b) of the grains" refers to the value of a standard deviation of the thickness (b) of the grains, divided by an average value of the thickness (b) of the grains, and then multiplied by 100. The terms "coefficient of variation of the twin plane interval (a)" and "coefficient of variation of the ratio (b/a)" are defined in the same manner as the above.

A method of forming {111} tabular grains will be described. Methods are known in which an additive (a crystal phase control agent) is added at the time of grain formation, to form a grain having a {111} plane as its outer surface. These methods are shown below.

| Pat. No. | Crystal phase control agent | Inventor |
|---|---|---|
| U.S. Pat. No. 4400463 | Azaindenes + thioether peptizer | Mascaski |
| U.S. Pat. No. 4783398 | 2-4-dithiazolidinone | Mifune, et al. |
| U.S. Pat. No. 4713323 | Aminopyrazolopyrimidine | Mascaski |
| U.S. Pat. No. 4983508 | Bispyridinium salt | Ishiguro, et al. |
| U.S. Pat. No. 5185239 | Triaminopyrimidine | Mascaski |
| U.S. Pat. No. 5178997 | 7-azaindole-series compound | Mascaski |
| U.S. Pat. No. 5178998 | Xanthine | Mascaski |
| JP-A-64-70741 | Dye | Nishikawa, et al. |
| JP-A-3-212639 | Aminothioether | Ishiguro |
| JP-A-4-283742 | Thiourea derivative | Ishiguro |
| JP-A-4-335632 | Triazolium salt | Ishiguro |
| JP-A-2-32 | Bispyridinium salt | Ishiguro, et al. |
| JP-A-8-227117 | Monopyridinium salt | Ohzeki, et al. |

As aforementioned, methods using various crystal phase control agents are disclosed. The compounds (compound examples 1 to 42) described in JP-A-2-32 are preferable and crystal phase control agents 1–29 described in JP-A-8-227117 are particularly preferable. However, the present invention is not limited to these compounds.

Basically, the {111} tabular grains for use in the present invention can be formed by three steps of nucleation, ripening and growing processes. When ultrafine grains are formed, the growing process can be omitted.

1) Nucleation Process

The tabular grains are obtained by forming two parallel twin planes. The formation of twin planes is affected by factors such as a temperature, a dispersion medium (gelatin), a halogen density, and addition speeds of a halogen and silver. At that time, the twin plane interval (a) is determined concurrently. Therefore, suitable conditions for these factors must be set.

JP-A-8-184931 discloses that it is preferred that no crystal habit-controlling agent is used during the nucleation in order to permit monodispersed grains. Likewise, it is also preferred that no crystal habit-controlling agent is used during the nucleation in order to enhance a monodispersion performance of the twin plane interval (a). The chloride concentration in the nucleation process preferably ranges from 0.001 mole/liter to 1 mole/liter, more preferably from 0.003 mole/liter to 0.1 mole/liter, furthermore preferably from 0.005 mole/liter to 0.05 mole/liter. Temperature during the nucleation may be properly selected from the range of 2° C. to 90° C., but it is preferably in the range of 5° C. to 70° C., more preferably in the range of 10° C. to 50° C., and especially preferably in the range of 15° C. to 45° C.

As to the kind of gelatin for use in the nucleation, ordinarily an alkali-treated gelatin is used. In addition, modified gelatin such as oxidation-treated gelatin, succinated gelatin, phthalated gelatin, and trimellitated gelatin may be also used. As to the molecular weight of gelatin, generally a gelatin having a molecular weight of 10,000 or more may be used. In order to permit a monodispersed twin plane interval (a), it is preferred to use a gelatin having a molecular weight of 60,000 or greater, more preferably a gelatin having a high molecular weight of 100,000 or greater. The gelatin concentration during the nucleation generally ranges from 0.03% to 10%, preferably from 0.05% to 1.0%.

In addition, in order to permit a monodispersed twin plane interval (a), it is preferred to incorporate gelatin into one or both of an aqueous $AgNO_3$ solution and an aqueous alkali halide solution, each of which is added during the nucleation. Alternatively, it is preferred to add an aqueous gelatin solution simultaneously with an aqueous $AgNO_3$ solution and an aqueous alkali halide solution. As such additional gelatin, the same materials as the foregoing gelatin for the nucleation may be used. In order to permit a monodispersed twin plane interval (a), it is preferred to use a gelatin having the same molecular weight as that of gelatin for the nucleation or a higher molecular weight type gelatin. The amount of additional gelatin to be added during the nucleation preferably ranges from 10% to 300%, more preferably from 15% to 200%, and especially preferably from 20% to 160%, of the amount of gelatin present at the initial stage of a nucleation process. The addition rate of the aqueous $AgNO_3$ solution preferably ranges from 4 g/min to 30 g/min, more preferably from 8 g/min to 20 g/min, per liter of the aqueous reacting solution.

It is preferred for nucleation of tabular grains that pCl value is in the range of 1.2 to 2.3. However, the value is preferably in the range of 1.2 to 1.8 in order to permit a monodispersed twin plane interval (a).

2) Ripening Process

In the initial stage of the nucleation process, nuclei of tabular grains are formed. However, directly after the nucleation, a number of nuclei other than tabular grains are also contained in a reaction vessel. Therefore, ripening is carried out subsequent to the nucleation. Furthermore, techniques by which only tabular grains survive whereas the grains other than the tabular grains disappear, are needed. If an ordinary Ostwald ripening is conducted, tabular grains (nuclei) also disappear by dissolution as well as the other grains, and therefore the number of tabular grain nuclei reduces. As a result, the size of the tabular grains thus obtained would increase. In order to prevent the foregoing phenomenon, a crystal habit-controlling agent is added. At that time, if the crystal habit-controlling agent is used in combination with a modified gelatin such as a phthalated gelatin, a succinated gelatin or a trimellitated gelatin, an effect of the crystal habit-controlling agent is enhanced, and not only a dissolution of the tabular grains is prevented, but also a growth of the tabular grains at the thickness direction is restrained. Consequently, such combination use is effective to make the thickness (b) of the tabular grain thinner, resulting in reduction of the (b/a) value. At that time, the amount of the modified gelatin to be added preferably ranges from 10 g to 1000 g, more preferably from 10 g to 600 g, per mole of silver nitrate to be added in the nucleation. The amount of the crystal habit-controlling agent to be used preferably ranges from $2\times10^{-3}$ mole to $20\times10^{-3}$ mole, more preferably from $6\times10^{-3}$ mole to $10\times10^{-3}$ mole, per mole of silver nitrate to be added in the nucleation. In order to reduce the (b/a) value, the gelatin and the crystal habit-controlling agent are preferably used in combination. When used in combination, the crystal habit-controlling agent and a gelatin solution may be added at the same time, or with a time lag. In order to enhance a monodispersion performance of the (b/a) value, it is preferred to add the gelatin and the crystal habit-controlling agent directly after the completion of nucleation. The term "directly after the completion of nucleation" refers to the period of time up to 10 minutes after the completion of addition of silver nitrate during the nucleation.

In order to permit a monodispersed thickness (b) of the tabular grain, pAg during a ripening process and a ripening temperature are especially important. The ripening pAg (vs a Ag/AgCl electrode) preferably ranges from 60 to 130 mV, especially preferably from 70 to 120 mV.

It is efficient from the viewpoint of acceleration of Ostwald ripening to set the ripening temperature higher than the nucleation temperature, especially preferably higher by 15° C. or more than the nucleation temperature. However, if the ripening temperature is high, the thickness of the tabular grains increases. Therefore, the ripening temperature is preferably 90° C. or less, and more preferably 80° C. or less.

3) Growing Process

The step of growing the formed nuclei by a physical ripening or an addition of both a silver salt and a halide will be described.

The concentration of chloride during the growing process is generally 5 mole/liter or less, preferably ranges from 0.05 to 1 mole/liter. Temperature during the growth of grains may be selected from the range of 10° C. to 95° C., but preferably ranges from 30° C. to 80° C.

In order to reduce the (b/a) value, it is preferred to further add a crystal habit-controlling agent during the growing process. As the timing of addition, the crystal habit-controlling agent may be added into a reaction vessel in advance just before growing. However, in order to enhance a monodispersion performance of the thickness (b) of the tabular grain, it is preferred to add a crystal habit-controlling agent and to increase a concentration of the agent in a reaction vessel, as the tabular grains grow. The term "just before growing" refers to the period of time from 0 to up to 10 minutes before the beginning of addition of silver nitrate for the growing process subsequent to a temperature-programmed ripening. A total amount of the crystal habit-controlling agent to be used is preferably $6\times10^{-5}$ mole or more, especially preferably ranges from $3\times10^{-4}$ mole to $6\times10^{-2}$ mole, per mole of silver halide present in the finished emulsion.

When the amount of a dispersion medium to be used during the nucleation or growing is insufficient to grow, the shortage must be supplied by adding the dispersion medium. It is preferred for the growth that gelatin is present in an amount of from 10 g/liter to 100 g/liter. As the gelatin to be supplied, a phthalated gelatin, a succinated gelatin and a trimellitated gelatin are preferred. The pH value at the time of nucleation is not limited in particular, but from neutral to acidic range is preferred.

The silver halide emulsion of the present invention can be applied to a silver halide light-sensitive material including a black and white light-sensitive material, preferably a silver halide photographic light-sensitive material, more preferably a silver halide color photographic light-sensitive material. Particularly preferred are a silver halide color photographic light-sensitive material having at least three silver halide emulsion layers, each of which has a different color sensitivity from each other.

The silver halide tabular grains for use in the present invention can be applied in any of a silver halide emulsion layer containing a yellow dye-forming coupler, a silver halide emulsion layer containing a magenta dye-forming coupler, and a silver halide emulsion layer containing a cyan dye-forming coupler. They are preferably used in at least one of the silver halide emulsion layer containing a yellow dye-forming coupler and the silver halide emulsion layer containing a magenta dye-forming coupler, most preferably used in the silver halide emulsion layer containing a yellow dye-forming coupler.

Various polyvalent metal ion impurities may be introduced into the silver halide emulsion of the present invention in a process of forming emulsion grains or in a physical ripening step. Examples of the compound of the metal to be used include salts or complex salts of metal of group VIII in the periodic table such as iron, iridium, ruthenium, osmium, rhenium, rhodium, cadmium, zinc, lead, copper and thallium, which may be used in combination. In the present invention, compounds of metal such as iron, ruthenium, osmium or rhenium which have at least four cyano ligands further improve the sensitivity at high intensity and also restrain latent image-sensitization and are hence particularly preferable. The amount of these compounds to be used is preferably $10^{-9}$ to $10^{-2}$ mol per one mol of silver halide, though its range is widespreading according to the purpose. These metal ions will be explained in more detail, which are not limiting of the present invention.

The iridium ion-containing compounds are trivalent or tetravalent salts or complex salts with the complex salts being preferable. For example, complex salts of halogens, amines, or oxalato, such as iridous (III) chloride, iridous (III) bromide, iridium (IV) chloride, sodium hexachloroiridate (III), potassium hexachloroiridate (IV), hexammineirridium (IV) salts, trioxalatoiridium (III) salts and trioxalatoiridium (IV) salts, are preferable. The platinum ion-containing compounds are divalent or tetravalent salts or complex salts with complex salts being preferable. For example, platinum (IV) chloride, potassium hexachloroplatinate (IV), tetrachloroplatinic (II) acid, tetrabromoplatinic (II) acid, sodium tetraxis(thiocyanato)platinate (IV) and hexammineplatinum (IV) chloride are used.

The palladium ion-containing compounds are generally divalent or tetravalent salts or complex salts with complex salts being particularly preferable. For example, sodium tetrachloropalladate (II), sodium tetrachloropalladate (IV), potassium hexachloropalladate (IV), tetramminepalladium (II) chloride and potassium tetracyanopalladate (II) are used. As the nickel ion-containing compounds, for example, nickel chloride, nickel bromide, potassium tetrachloronickelate (II), hexamminenickel (II) chloride and sodium tetracyanonickelate (II) are used.

As the rhodium ion-containing compounds, trivalent salts or complex salts are generally preferable. For example, potassium hexachlororhodate, sodium hexabromorhodate and ammonium hexachlororhodate are used. The iron ion-containing compounds are compounds containing a divalent or trivalent iron ion, preferably iron salts or iron complex salts, which are soluble in water in the range of concentration to be preferably used, and particularly preferably iron complex salts that are easily contained in silver halide grains. Examples of the iron salts and iron complex salts include ferrous chloride, ferric chloride, ferrous hydroxide, ferric hydroxide, ferrous thiocyanide, ferric thiocyanide, hexacyanoiron (II) complex salts, hexacyanoiron (III) complex salts, ferrous thiocyanate complex salts and ferric thiocyanate complex salts. Six-coordinate metal complexes having at least 4 cyano ligands, as described in European Patent No. 336,426A are also preferably used.

The aforementioned metal ion-providing compound may be contained in the silver halide grains of the present invention by the following measures. For example, the metal ion-providing compound is added, at the time of forming the silver halide grains, in a dispersion medium, such as an aqueous gelatin solution, aqueous halide solution, aqueous silver salt solution or aqueous solution of other compounds, or in the form of a silver halide fine grains made to contain the metal ion in advance, and the fine grains are then dissolved. Also, the metal ion used in the present invention is made to be contained in the grains either before or during or just after the formation of grains. This timing may be changed depending on which position of the grain to select as the place where the metal ion is to be contained.

The process of preparing the silver halide emulsion in the present invention, as is widely known in general, involves a step of forming silver halide grains by a reaction between a water-soluble silver salt and a water-soluble halide, a desalting step and a chemical ripening step.

The silver halide emulsion of the present invention is generally subjected to chemical sensitization. As to the chemical sensitization method, sulfur sensitization typified by the addition of an unstable sulfur compound, noble metal sensitization typified by gold sensitization, and reduction sensitization may be used independently or in combination. As compounds used for the chemical sensitization, those described in JP-A-62-215272, page 18, right lower column to page 22, right upper column are preferably used.

The silver halide emulsion of the present invention is preferably subjected to gold sensitization as is known in this industrial field. This is because the gold sensitization can further decrease a variation in the photographic properties when scanning exposure is performed using laser light or the like. To carry out gold sensitization, a compound such as chloroauric acid or its salt, or gold thiocyanates or gold thiosulfates may be used. The amount of each of these compounds to be added is preferably $5\times10^{-7}$ to $5\times10^{-3}$ mol and more preferably $1\times10^{-6}$ to $1\times10^{-4}$ mo, per one mol of silver halide, though it may be changed in a wide range according to the case.

In the present invention, gold sensitization may be used in combination with other sensitizing method, for example, sulfur sensitization, selenium sensitization, tellurium sensitization, reduction sensitization, or noble metal sensitization using a noble metal other than a gold compound.

The silver halide emulsion of the present invention may contain various compounds for the purpose of preventing fogs during the production step, storage and photographic processing of the emulsion or the light-sensitive material, or for the purpose of stabilizing the photographic properties. Namely, many compounds known as the antifoggant or stabilizer may be added. Examples of these compounds include azoles, e.g., benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiaidiazoles, aminotriazoles, benzotriazoles, nitrobenzotriazoles, mercaptotetrazoles (particularly, 1-phenyl-5-mercaptotetrazole and the like), mercaptopyrimidines, mercaptotriazines; thioketo compounds, e.g., oxadoline thion; azaindenes, e.g., triazaindenes, tetrazaindenes (particularly, 4-hydroxy substituted (1,3,3a,7)tetrazaindene), pentazaindenes; benzenethiosulfonic acid, benzenesulfinic acid, benzenesulfonic acid amide. Particularly preferable compounds are mercaptotetrazoles. These mercaptotetrazoles are preferable since they have the ability of more increasing sensitivity at high intensity, in addition to the aforementioned abilities of preventing fogging and improving the stability.

In the light-sensitive material according to the present invention, for the purpose of improving the sharpness or the like of images, dyes (particularly oxonol-type dyes), which can be decolored by processing described on pages 27 to 76 in European Patent Application No. 337,490A2, are preferably added to the hydrophilic colloidal layer such that the optical reflection density of the light-sensitive material at 680 nm becomes 0.70 or more, or that 12 wt % or more (more preferably 14 wt % or more) of titanium oxide which is surface-treated with di- to tetra-hydric alcohols (e.g. trimethylol ethane) is preferably contained in a water-resistant resin layer of a support.

In the silver halide color photographic light-sensitive material according to the present invention, gelatin can be used as the hydrophilic binder, but hydrophilic colloids of other gelatin derivatives, graft polymers between gelatin and other polymers, proteins other than gelatin, sugar derivatives, cellulose derivatives and synthetic hydrophilic polymeric materials such as homopolymers or copolymers can also be used in combination with gelatin, if necessary.

Gelatin to be used in the silver halide color photographic light-sensitive material according to the present invention may be either lime-treated or acid-treated gelatin or may be gelatin produced from any of cow bone, cowhide, pig skin, or the like, as the raw material, preferably lime-treated gelatin produced from cow bone or pig skin as the raw material.

In the present invention, the total amount of the hydrophilic binder contained in the light-sensitive silver halide emulsion layer(s) and the non-light-sensitive hydrophilic colloidal layer(s) that are layers between the support and the hydrophilic colloidal layer furthest from the support at the side coated with the silver halide emulsion layer, is preferably 6.5 g/m$^2$ or less, most preferably 5.5 g/m$^2$ or less but 4.0 g/m$^2$ or more, in view of rapid processing. A lower content of the hydrophilic binder is particularly effective for enhancing the speed in the steps of color development and washing with water.

In the present invention, the silver halide emulsion layer furthest from the support refers to a layer containing a silver halide emulsion that can substantially contribute to dye-forming upon reaction of the coupler, via the development of the silver halide emulsion contained in the layer. Accordingly, the silver halide emulsion layer does not include a coupler-free layer only containing a fine-grain emulsion or colloidal silver which is substantially not sensitive.

In the present invention, the ratio of {amount of hydrophilic binder/thickness of silver halide} in every silver halide emulsion layer is preferably 1.5 or more. In the present invention, this ratio is hereinafter referred to as a (B/AgX) ratio.

As used herein, the amount of hydrophilic binder refers to the amount of hydrophilic binder (g/m$^2$) per m$^2$ of the silver halide emulsion layer. Since the amount of the hydrophilic binder is divided by the specific gravidity to represent thickness, the amount of the hydrophilic binder in the present invention can be seen to be an amount proportional to thickness.

On the other hand, the thickness of the silver halide emulsion refers to a thickness ($\mu$m) occupied by silver halide emulsion grains in a direction perpendicular to the support in the silver halide emulsion layer. Assuming that the silver halide emulsion layer is ideally coated, the thickness of the silver halide emulsion in the present invention is the side length ($\mu$m) of a cube in the case of cubic grains, or is the thickness ($\mu$m) in a perpendicular direction to a major face in the case of tabular grains. When two or more kinds of silver halide emulsion grains different in their size are mixed and used, the thickness of silver halide emulsion is the mass average value of all the grains.

As is clear from the following definition, the thickness of the emulsion in the emulsion layer is relatively decreased as the (B/AgX) ratio in the present invention is increased. From the viewpoint of restricting pressure marks (streaks) and reducing processing color-mixing in the present invention, the (B/AgX) ratio is 1.50 or more, preferably 1.70 or more, further preferably 1.90 or more, most preferably 6.0 or more.

In the present invention, the silver halide emulsion layer containing a yellow coupler may be arranged in any position on the support. The layer containing a yellow coupler is provided by coating preferably in a position more apart from the support than at least one layer of the magenta coupler-containing silver halide emulsion layer and/or the cyan coupler-containing silver halide emulsion layer. Further, from the viewpoint of acceleration of color development, acceleration of silver removal and reduction of a residual color by a sensitizing dye, the yellow coupler-containing silver halide emulsion layer is provided preferably in the most apart position from the support than the other silver halide emulsion layers. Further, from the viewpoint of a reduction in Blix discoloration, the cyan coupler-containing silver halide emulsion layer is preferably a middle layer between the other silver halide emulsion layers, and from the viewpoint of a reduction in light discoloration, the cyan coupler-containing silver halide emulsion layer is preferably the lowermost layer. Further, each color-forming layer of yellow, magenta or cyan may be composed of 2 or 3 layers. For example, it is also preferable that a coupler layer not containing a silver halide emulsion is arranged to be adjacent to the silver halide emulsion layer to form a color-forming layer, as described in JP-A-4-75055, JP-A-9-114035, JP-A-10-246940, U.S. Pat. No. 5,576,159, etc.

The yellow coupler-containing silver halide emulsion layer is preferably provided most apart from the support than the other silver halide emulsion layers. In the yellow coupler-containing silver halide emulsion layer, the amount of the hydrophilic binder is preferably 1.35 g/m$^2$ or less, more preferably 1.25 g/m$^2$ or less, most preferably 1.20 g/m$^2$ or less but 0.60 g/m$^2$ or more. Further, with respect to the thickness of the silver halide emulsion, the side length in the case where cubic grains are used is preferably 0.80 $\mu$m or less, more preferably 0.75 $\mu$m or less, most preferably 0.70 $\mu$m or less but 0.30 $\mu$m or more, and the side length in the case where tabular grains are used (a length of a side in terms of a length of the side of a cubic having the same volume as the grain) is preferably 0.40 $\mu$m or less but 0.02 $\mu$m or more, more preferably 0.30 $\mu$m or less, further preferably 0.20 $\mu$m or less, most preferably 0.15 $\mu$m or less but 0.05 $\mu$m or more. A mixture of silver halide emulsions having different sizes and shapes is preferably used to control sensitivity, gradation and other photographic performance.

In the present invention, the amount of the silver halide emulsion to be coated is preferably 0.60 to 0.10 g/m$^2$, more preferably 0.55 to 0.20 g/m$^2$ or more, most preferably 0.50 to 0.25 g/m$^2$.

When cubic silver halide emulsion grains are used in the cyan-color-forming layer and the magenta-color-forming layer, the side length thereof is preferably 0.50 μm or less, more preferably 0.40 μm or less but 0.10 μm or more.

In the present invention, the film thickness in the constitution of the photographic layer means the thickness, before processing, in the constitution of the photographic layer which is a layer over the support. Specifically, the film thickness-can be obtained in any one of the following methods. In the first method, the film thickness can be obtained by cutting the silver halide color photographic light-sensitive material in a direction perpendicular to the support, and observing its cut surface under a microscope. The second method is a method of calculating the film thickness from the coating amount ($g/m^2$) and specific gravity of each component in the constitution of the photographic layer.

For example, the specific gravity of typical gelatin for use in photography is 1.34 g/ml, and the specific gravity of silver chloide is 5.59 g/ml, and other lipophilic additives are previously measured before coating, whereby the film thickness can be calculated in the second method.

In the present invention, the film thickness in the photographic layer constitution is preferably 9.0 μm or less, more preferably 8.0 μm or less, most preferably 7.0 μm or less but 3.5 μm or more.

In the present invention, the hydrophobic photographic material is an oil-soluble ingredient excluding the dye-forming coupler, and the oil-soluble ingredient is a lipophilic component remaining in the light-sensitive material after processing. Specific examples of the oil-soluble ingredient include the dye-forming coupler, a high-boiling organic solvent, a color-mixing inhibitor, an ultraviolet absorber, lipophilic additives, a lipophilic polymer or polymer latex, a matt agent, a slip (sliding) agent or the like, which are usually added as lipophilic fine grains to the photograph-constituting layer. Accordingly, a water-soluble dye, a hardening agent, water-soluble additives and silver halide emulsions are not included in the oil-soluble ingredient. Further, a surfactant is usually employed in preparing lipophilic fine grains, and the surfactant is not regarded as the oil-soluble ingredient in the present invention.

The total amount of the oil-soluble ingredient in the present invention is preferably 4.5 g/m or less, further preferably 4.0 $g/m^2$ or less, most preferably 3.8 $g/m^2$ or less but 3.0 $g/m^2$ or more. In the present invention, the value obtained by dividing the weight ($g/m^2$) of the hydrophobic photographic material contained in the dye-forming coupler-containing layer by the weight ($g/m^2$) of said dye-forming coupler, is preferably 4.5 or less, more preferably 3.5 or less, most preferably 3.0 or less.

In the present invention, the ratio of the oil-soluble ingredient in the photographic layer constitution to the hydrophilic binder can be arbitrarily selected. The ratio thereof by weight in the photographic layer constitution other than the protective layer is preferably 0.05 to 1.50, more preferably 0.10 to 1.40, most preferably 0.20 to 1.30. By optimizing the ratio of each layer, the film strength, abrasion resistance and curl characteristics can be regulated.

The color photographic light-sensitive material of the present invention has at least one silver halide emulsion layer containing a silver halide emulsion of the present invention. As the other silver halide which can be used in the color light-sensitive material of the present invention, silver chloride, silver bromide, silver (iodo)chlorobromide, silver iodobromide and so on may be used. It is preferred from the purpose of rapid processing in particular to use a high silver chloride emulsion having a silver chloride content of 90 mole % or greater, more preferably 95 mole % or greater, and especially preferably 98 mole % or greater. Further, use of the {111} tabular grains enables to increase the ratio of (B/Ag), which results in advances in color processing speed and reduction of a processing color-mixing.

In the light-sensitive material according to the present invention, it is preferable from the purposes of improving an image sharpness and so on that processing-decolorizable dyes (especially oxonol dyes), which are described in European Patent No. 0,337,490 A2, pp. 27 to 76, are added to a hydrophilic colloid layer so that an optical reflection density of said light-sensitive material at 680 nm becomes 0.70 or more, or alternatively titanium oxide surface-treated with a 2- to 4-valent alcohol (e.g., trimethylol ethane) is contained in a water-proof resin layer of the support in an amount of 12% by weight or more (more preferably 14% by weight or more).

In the silver halide photographic light-sensitive material according to the present invention, other materials and additives which are known for photography, may be used.

For example, as the photographic support, a transmission type support and a reflection type support may be used. As the transmission type support, preferably used are those transmission films of such as cellulose nitrate and polyethylene terephthalate, and further polyesters such as a polyester of 2,6-naphthalenedicarboxylic acid (NDCA) and ethylene glycol (EG), and a polyester of NDCA, terephthalic acid and EG, 2 each of these polyesters having thereon an information-recording layer such as a magnetic layer. As the reflection type support, a reflective support in which a substrate is laminated with water-proof resin layers (laminate layers) composed of two or more polyethylene layers or polyester layers, at least one of the water-proof resin layers containing a white pigment such as titanium oxide, is especially preferred.

Further, it is preferred to contain a fluorescent brightening agent in the water-proof resin layer. Further, the fluorescent brightener may be dispersed in the hydrophilic colloidal layer of the light-sensitive material. As the fluorescent brightener, preferably use can be made of benzoxazole-series, coumarin-series or pyrazoline-series, and more preferably benzoxazolyl naphthalene-series and benzoxazolyl stilbene-series fluorescent brightener. Although the amount to be used thereof is not particularly limited, it is preferably 1 to 100 $mg/m^2$. When mixed in a water-resistant resin, the mixing ratio thereof to the water-resistant resin is preferably 0.0005 to 3% by weight, more preferably 0.001 to 0.5% by weight.

The reflection type support may be a reflective support in which a hydrophilic colloid layer containing a white pigment may be coated on a transmission type support or the above-mentioned reflection type support.

Further, the reflection type support may be a support having a metal surface which provides a property of mirror reflection or diffuse reflection of the second kind.

In the light-sensitive material according to the present invention, reflective supports (reflection type supports) are preferred.

The above-mentioned reflective-type bases (supports), the silver halide emulsion, heterogeneous metal ion species which can be doped in silver halide grains, storage stabilizers or antifoggant for the silver halide emulsion, chemical sensitization methods (sensitizers), spectral sensitization methods (spectral sensitizers), cyan, magenta or yellow couplers, and the emulsification and dispersion methods of the couplers, color image-storability improvers (stain inhibitor and anti-fading agents), dyes (colored layers), gelatin species, the layer structure of the light-sensitive material, and the pH of a coating of the light-sensitive material, each of which can be preferably applied to the present invention, include those described in the patent applications in the following Tables 1 and 2.

TABLE 1

| Element | JP-A-7-104448 | JP-A-7-77775 | JP-A-7-301895 |
|---|---|---|---|
| Reflective-type bases | Column 7, line 12 to Column 12, line 19 | Column 35, line 43 to Column 44, line 1 | Column 5, line 40 to Column 9, line 26 |
| Silver halide emulsions | Column 72, line 29 to Column 74, line 18 | Column 44, line 36 to Column 46, line 29 | Column 77, line 48 to Column 80, line 28 |
| Heterogeneous metal ion species | Column 74, lines 19 to 44 | Column 46, line 30 to Column 47, line 5 | Column 80, line 29 to Column 81, line 6 |
| Storage stabilizers or antifoggants | Column 75, lines 9 to 18 | Column 47, lines 20 to 29 | Column 18, line 11 to Column 31, line 37 (Especially, mercaptohetero-cyclic compounds) |
| Chemical sensitizing methods (Chemical sensitizers) | Column 74, line 45 to Column 75, line 6 | Column 47, lines 7 to 17 | Column 81, lines 9 to 17 |
| Spectrally sensitizing methods (Spectral sensitizers) | Column 75, line 19 to Column 76, line 45 | Column 47, line 30 to Column 49, line 6 | Column 81, line 21 to Column 82, line 48 |
| Cyan couplers | Column 12, line 20 to Column 39, line 49 | Column 62, lines 50 to 16 | Column 88, line 49 to Column 89, line 16 |
| Yellow couplers | Column 87, line 40 to Column 88, line 3 | Column 63, lines 17 to 30 | Column 89, lines 17 to 30 |
| Magenta couplers | Column 88, lines 4 to 18 | Column 63, line 3 to Column 64, line 11 | Column 31, line 34 to Column 77, line 44 and column 88, lines 32 to 46 |
| Emulsifying and dispersing methods of couplers | Column 71, line 3 to Column 72, line 11 | Column 61, lines 36 to 49 | Column 87, lines 35 to 48 |

TABLE 2

| Element | JP-A-7-104448 | JP-A-7-77775 | JP-A-7-301895 |
|---|---|---|---|
| Dye-image-storability improbing agents (anti-stain Agents) | Column 39, line 50 to Column 70, line 9 | Column 61, line 50 to Column 62, line 49 | Column 87, line 49 to Column 88, line 48 |
| Anti-fading agents | Column 70, line 10 to Column 71, line 2 | | |
| Dyes (colored layers) | Column 77, line 42 to Column 78, line 41 | Column 7, line 14 to Column 19, line 42, and Column 50, line 3 to Column 51, line 14 | Column 9, line 27 to Column 18, line 10 |
| Gelatins | Column 78, lines 42 to 48 | Column 51, lines 15 to 20 | Column 83, lines 13 to 19 |
| Layer construction of light-sensitive materials | Column 39, lines 11 to 26 | Column 44, lines 2 to 35 | Column 31, line 38 to Column 32, line 33 |
| pH of coatings of light-sensitive material | Column 72, lines 12 to 28 | | |
| Scanning exposure | Column 76, line 6 to Column 77, line 41 | Column 49, line 7 to Column 50, line 2 | Column 82, line 49 to Column 83, line 12 |
| Preservatives in developing solution | Column 88, line 19 to Column 89, line 22 | | |

The timing for addition of sensitizing dyes to the silver halide emulsion of the present invention is not limited in particular, as long as they are added in any of the steps for the preparation of a silver halide emulsion, which is recognized to be useful. Namely, they may be added in any time and any step before the emulsion is coated, for example, the step of silver halide grain formation and/or the time before desalting; during the desalting and/or the time ranging from the completion of desalting to before the beginning of chemical ripening, as described in U.S. Pat. Nos. 2,735,766, 3,628,960, 4,183,756, 4,225,666, JP-A-58-184142 and JP-A-60-196749; the time just before chemical ripening or during the chemical ripening; and the time ranging from the completion of chemical ripening to before coating the emulsion, as described in JP-A-58-113920. Further, as described in U.S. Pat. No. 4,225,666 and JP-A-58-7629, the same compound may be added alone, or in combination with another compound having a different structure from each other, for example, in the same step, or in different steps. For example, the addition step may be separated into steps of the grain formation and the chemical ripening or after the completion of chemical ripening, or alternatively into the steps of before the beginning of chemical ripening or during the chemical ripening and after the completion of chemical ripening. Further, the kind of a compound and a combination of the compounds which are separately added, may be changed for addition.

Further, a fixed amount of sensitizing dyes may be added in a short time, or alternatively they may be added successively in any step over a long period of time, for example, extending from the nucleation during the grain formation to the completion of the grain formation, or over a great period of the chemical ripening step. The addition speed in such a case may be an isokinetic flow rate. Alternatively, the flow rate may be accelerated, or decelerated.

The temperature at which a sensitizing dye is added to the silver halide emulsion, is not limited in particular, but generally it is in the range of 35° C. to 70° C. An addition temperature and a ripening temperature may be different from each other. It is more preferable that a sensitizing dye is added at a temperature of 45° C. or less and then the temperature is increased to initiate ripening.

The total addition amount of dyes for use in the present invention varies depending on the shape and size of silver halide grains, but it is generally in the range of $5.5\times10^{-6}$ to $1.2\times10^{-2}$ mole, per mole of silver halide. For example, in the case where the grain size of silver halide is in the range of 0.2 to 2.0 $\mu$m, the addition amount preferably ranges from $4.0\times10^{-7}$ to $6.5\times10^{-6}$ mole, more preferably from $1.0\times10^{-6}$ to $4.2\times10^{-6}$ mole, per m2 of surface area of silver halide grains.

The cyan, magenta and yellow couplers, which are used in combination in the present invention, include those described in Table 1 above, and further the following couplers are useful: the couplers described on page 91, upper right column, line 4 to page 121, upper left column, line 6 in JP-A-62-215272; page 3, upper right column, line 14 to page 18, upper left column, bottom line, and page 30, upper right column, line 6 to page 35, lower right column, line 11 in JP-A-2-33144; page 4, lines 15 to 27, page 5, line 30 to page 28, bottom line, page 45, lines 29 to 31, and page 47, line 23 to page 63, line 50 in EP0355,660A2; JP-A-8-122984; JP-A-9-222704; and the like. Further, as the cyan coupler, pyrrolotriazole couplers are preferably used. In particular, couplers represented by formula (I) or (II) described in JP-A-5-313324 and couplers represented by formula (I) described in JP-A-6-347960, and in addition exemplified couplers described in these patent publications are preferred. As the magenta coupler, pyrazoloazole couplers represented by formula (M-I) described in JP-A-8-122984 are particularly preferred. The descriptions of the paragraph Nos. 0009 through 0026 of JP-A-8-122984 can be applied to the present invention and therefore incorporated herein by reference as a part of the specification of the present application.

In the present invention, a known color-mixing prevention agent may be used. Among these, those described in the patent publications exemplified in the following are preferable.

For example, high-molecular-weight redox compounds described in JP-A-5-333501, phenidone- or hydrazine-series compounds described in W098/33760 and U.S. Pat. No. 4,923,787, and white couplers described in JP-A-5-249637, JP-A-10-282615 and German Patent No. 19629142A1 may be used. Particularly in the case of intending to increase the pH of a developer and to accelerate development processing, redox compounds described in German Patent No. 19618786A1, German Patent No. 19806846A1, European Patent No. 839623A1, European Patent No. 842975A1, and French Patent No. 2760460A1 are preferably used.

In the present invention, preferably an ultraviolet light absorber having high molar extinction coefficient is used as an ultraviolet light absorber. As these compounds, for example, compounds containing a triazine skeleton may be used, and compounds described, for example, in JP-A-46-3335, JP-A-55-152776, JP-A-5-197074, JP-A-5-232630, JP-A-5-307232, JP-A-6-211813, JP-A-8-53427, JP-A-8-234364, JP-A-8-239368, JP-A-9-31067, JP-A-10-115898, JP-A-10-147577, JP-A-10-182621, JP-T-8-501291 ("JP-T" means published searched patent publication), European Patent No. 711804A, and German Patent No. 19739797A, are preferable.

As the antiseptic and mildew-proofing agent that can be used in the present invention, those described in JP-A-63-271247 are useful. As the hydrophilic colloid used for <*U; the photographic layer constituting the light-sensitive material, gelatin is preferable, in which, particularly, heavy metals, such as iron, copper, zinc and manganese, which are contained as impurities, are preferably 5 ppm or less, and more preferably 3 ppm or less.

The amount of calcium contained in the light-sensitive material is preferably 20 mg/m$^2$ or less, more preferably 10 mg/m$^2$ or less and most preferably 5 mg/m$^2$ or less.

The light-sensitive material of the present invention is suitable to a scanning exposure system using a cathode ray tube (CRT), besides the case where it is used as the usual printing system using a negative printer.

An exposure apparatus using a cathode ray tube is simpler, more compact and lower in cost than apparatuses using a laser. Also, the regulations of the light axis and color are easy.

As the cathode ray tube used for image exposure, various emitters (light-emittable substances) which emit in a spectrum range are used, according to necessity. For example, any one of a red-light emitter, a green-light emitter and a blue-light emitter or combinations of two or more of these emitters are used. The spectrum range is not limited to the aforementioned red, green or blue, and fluorescent substances which emit in a yellow, orange, violet or infrared range may also be used. Especially, cathode ray tubes which combine these emitters with each other to emit white-light are often used.

When the light-sensitive material has plural light-sensitive layers with different distributions of spectral sensitivity, and the cathode ray tube also has a fluorescent substance(s) which emits in plural spectrum ranges, plural colors may be exposed to light simultaneously, specifically, image signals of plural colors may be input to the cathode ray tube to emit light from the tube surface. A method (exposure performed alternately side by side) may be adopted in which the image signals of each color are input alternately to emit each color alternately and exposure is carried out through a film which cuts colors except for the target color. In general, the exposure performed alternately side by side is preferable to obtain a high quality image because it can use a cathode ray tube with high resolution.

The light-sensitive material of the present invention is preferably used in a digital scanning exposure system using monochromatic high density light, such as a gas laser, light-emitting diode, semiconductor laser, and second harmonic-generating light-source (SHG) obtained by combining a semiconductor laser or a solid laser using a semiconductor laser as an exciting light source with a non-linear optical crystal. It is preferable to use a semiconductor laser or a second harmonic-generating light-source (SHG) obtained by combining a semiconductor laser or a solid laser with a non-linear optical crystal, to make the system compact and inexpensive. In order to design an apparatus which is compact and inexpensive and further has a long life and high stability in particular, the use of a semiconductor laser is preferable, and it is preferable to use a semiconductor laser in at least one of the light sources used for exposure.

When such a light source for scanning exposure is used, the maximum wavelength of spectral sensitivity of the light-sensitive material of the present invention may be optionally designed according to the wavelength of the light source for scanning exposure to be used. In the SHG light source obtained by combining a solid laser using a semiconductor laser as an exciting light source or a semiconductor laser with a non-linear optical crystal, blue light and green light can be obtained since the oscillation wavelength of a laser can be halved. It is possible to allow the light-sensitive material to have the maximum wavelength of spectral sensitivity in usual three wavelength ranges of blue, green and red accordingly.

The exposure time required for such a scanning exposure is preferably 10 sec or less and more preferably $10^{-6}$ sec or less, on the premise that it is defined as the time required for exposing a pixel size in the case where the density of a pixel is assumed to be 400 dpi.

Preferable scanning exposure systems which can be applied to the present invention are described in detail in the patents listed in the aforementioned table.

When the light-sensitive material of the present invention is processed, processing materials and processing methods described in JP-A-2-207250, page 26, right lower column, first line to page 34, right upper column, line 9, and JP-A-4-97355, page 5, left upper column, line 17 to page 18, right lower column, line 20, are preferably used. Also, as the preservative used for the developer, the compounds described in the patents listed in the aforementioned table are preferably used.

As the method of subjecting the light-sensitive material of the present invention to development after exposure, the following systems may be used. These systems include a wet system, such as a method of processing using a developer containing a conventional alkali agent and a developing agent, and a method in which a developing agent is included in the light-sensitive material and an activator solution such as an alkali solution containing no developing agent is used to process; and a thermal developing system using no processing solution. In the method using an activator solution in particular, the developing agent is not contained in the processing solution and hence the processing solution is easily controlled and handled. This method is also less in the burden of waste water treatment, showing that it is also a preferable method in view of environmental protection.

In the method using an activator solution, as the developing agent or its precursor to be included in the light-sensitive material, for example, hydrazine-type compounds described in JP-A-8-234388, JP-A-9-152686, JP-A-9-152693, JP-A-9-211814 and JP-A-9-160193 are preferable.

In addition, development methods in which the amount of silver to be applied in a light-sensitive material is decreased and image-amplifying treatment (intensifying treatment) using hydrogen peroxide is performed are preferably used. It is particularly preferable to use this method in the method using an activator solution. Specifically, an image-forming method using an activator solution containing hydrogen peroxide, as disclosed in JP-A-8-297354 and JP-A-9-152695, is preferably used.

In the method using an activator solution, the light-sensitive material is generally subjected to desilvering treatment after it is treated using an activator solution. In the image-amplifying treatment method using a light-sensitive material with a lower silver amount, the desilvering treatment may be omitted and a simple method such as washing or stabilizing treatment may be used instead. In the system in which image information is read from a light sensitive material by using a scanner or the like, a processing method requiring no desilvering process may be adopted even when a light-sensitive material, e.g., a light-sensitive material for shooting, having high silver content is used.

As the activator solution, a desilvering solution (bleaching/fixing solution), and processing materials for a washing or stabilizing solution, and the washing or stabilizing method, known materials and methods may be used in the present invention. Preferably those described in Research Disclosure Item 36544 (September 1994) pp. 536–541 and in JP-A-8-234388 may be used.

In the present invention, the color-development time means the time which elapses since the light-sensitive material is introduced into a color-developer until it is introduced in a bleach-fixing solution in the subsequent processing step. For example, when the light-sensitive material is processed in, for example, an automatic developing machine, the color-development time means the sum of both the time (a so-called time-in-solution) during which the light-sensitive material is immersed in a color-developer and the time (a so-called time-in-air) during which the light-sensitive material is taken out of the color-developer and conveyed in air towards a bleach-fixing bath in the subsequent step. Likely, the bleach-fixing time means the time which elapses since the light-sensitive material is introduced into a bleach-fixing solution until it is introduced into a washing or stabilizing bath in the subsequent step. Also, the washing or stabilizing time means the time (a so-called time-in-solution) during which the light sensitive material is held in a solution since it is introduced into a washing or stabilizing solution until it is taken out toward a drying step.

In a rapid processing at which one embodiment of the present invention aims, the color-development time is preferably 30 sec or less, more preferably 20 sec or less, and most preferably 15 sec or less and 6 sec or more. Likely the bleach-fixing time is preferably 30 sec or less, more preferably 20 sec or less, and most preferably 15 sec or less and 6 sec or more. Also, the washing or stabilizing time is preferably 40 sec or less, more preferably 30 sec or less, and most preferably 20 sec or less and 6 sec or more.

As a drying method according to the present invention, any one of the methods which are conventionally known to dry color photographic light-sensitive materials rapidly may be adopted. In the present invention, it is preferable to dry a color photographic light-sensitive material within 20 sec, more preferably within 15 sec, and most preferably in 5 sec to 10 sec.

As the drying system, any one of a contact heating system and a hot air-blowing system may be used, and a structure of a combination of the contact heating system and the hot air-blowing system makes it possible to carry out drying more rapidly than the above independent system, and the combination is hence preferable. In a more preferred embodiment concerning the drying method according to the present invention, the light-sensitive material is contact-heated using a heat-roller and then blow-dried using hot air blown toward the light-sensitive material from a perforated panel or nozzles. It is preferable that, in the blow-drying section, the mass velocity of the hot air blown per heat-receiving unit area of the light-sensitive material be 1000 $kg/m^2 \cdot hr$ or more. The diffuser (outlet of blown air) has preferably a shape less in pressure loss and examples of the shape are given in FIG. 7 to FIG. 15 described in JP-A-9-33998.

The light-sensitive material of the present invention has a rapid processing property and is less in both fogging and fluctuation of sensitivity due to activities of the developing solution, and in addition, it has a suitability not only to a "surface exposure" (an ordinary flooding exposure) but also particularly to a high illumination intensity scanning exposure. Therefore, an excellent image can be obtained by the above-described short color developing time.

The silver halide emulsion of the present invention is high sensitive because it is a silver halide {111} tabular grain emulsion, and grains therein are prevented from being dissolved. Further, the silver halide emulsion of the present invention is excellent in development progress characteristics, and development processing stability to fluctuation of activities of the developing solution, a mixing of a bleach-fixing solution in the developing solution, and the like. The light-sensitive material of the present invention using the above-mentioned emulsion is able to form an image having a definite quality, even though properties such as activities of the developing solution are changed. The light-sensitive material of the present invention is excellent in rapid processing suitability, and the color image-forming method of the present invention therefore enables to form an image with a high sensitivity and stability.

The present invention will be explained in more detail by way of the following examples, which are not intended to be limiting of the present invention.

EXAMPLE

Example 1

(Preparation of Emulsion A of this Invention)

1.0 g of sodium chloride and 2.2 g of an inert gelatin were added to 1.2 liter of water in a vessel. To the vessel kept at 26° C., 80 ml of an aqueous silver nitrate solution (A-1) (18 g of silver nitrate) and 80 ml of an aqueous sodium chloride solution (N-1) (6.2 g of sodium chloride) containing 2 g of an inert gelatin were added while stirring over the period of 1 minute by a double jet method. 1 minute later after the completion of addition, 500 ml of an aqueous 10% phthalated gelatin solution (G-1) and 20 ml of an aqueous solution (K-1) containing 1.2 mmole of Crystal habit-controlling agent 1 were added. Further, 1 minute later, 2.0 g of sodium chloride was added. Then, the temperature of the reaction vessel was elevated to 50° C. over the period of subsequent 24 minutes. The reaction mixture was ripened at 50° C. for 30 minutes. Further, after adding 3 g of sodium chloride, 530 ml of an aqueous silver nitrate solution (A-2)(210 g of silver nitrate) and 530 ml of an aqueous sodium chloride solution (N-2) (90 g of sodium chloride) were added by an accelerated flow rate over the period of 27 minutes. During the above-mentioned addition, 2 mmole of the crystal habit-controlling agent 1 was added by the accelerated flow rate (in proportion to the addition amount of silver nitrate). Further, 145 ml of an aqueous silver nitrate solution (A-3) (57 g of silver nitrate) and 145 ml of an aqueous sodium chloride solution (N-3) (19.6 g of sodium chloride) containing 12 mg of yellow prussiate of potash were added. Further, blue-sensitive spectrally sensitizing dyes A, B and C were added in the total amount of $8\times10^{-4}$ mole, per mole of silver, and 12 g of sodium dodecylbenzenesulfonate (DBS) was added. Thereafter, temperature of the resulting emulsion was elevated to 75° C. and allowed to stand for 30 minutes.

Sensitizing dye A

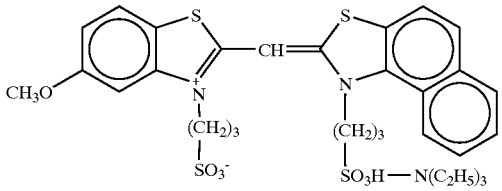

Sensitizing dye C

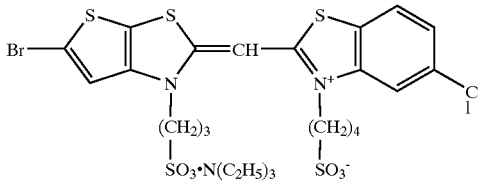

Sensitizing dye B

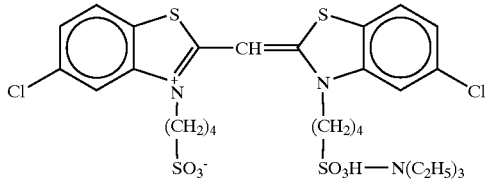

-continued

Crystal habit controlling agent 1

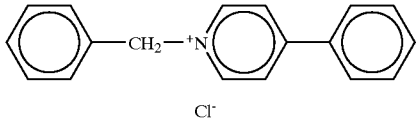

A sedimentation washing was carried out at 40° C. for desalting. Further, 130 g of a lime-treated gelatin was added, and then the values of pH and pAg were adjusted to 6.2 and 7.0 respectively. Thereafter, a mixture of $4\times10^{-4}$ mole of sodium thiosulfonate and $1\times10^{-4}$ mole of sodium thiosulfinate, per mole of silver respectively was added, and then an optimum chemical sensitization was carried out using chloroauric acid and 1-(3-methylureidophenyl)-5-mercaptotetrazole.

From the electron microscopic photograph, it was found that among the thus-obtained grains (A), tabular grains (which have {111} major faces; the same is also applied in each of the following Emulsions B to G) having the grain thickness of 0.30 μm or less and the aspect ratio of 2 or more, account for 96% or more of the total grain projected area. In addition, the average aspect ratio was 7.1, the average grain thickness was 0.114 μm and the average equivalent circle diameter was 0.81 μm.

Then, the emulsion containing said tabular grains was coated on a support, to prepare a sample in which the tabular grains were arranged in parallel to the support. The sample thus prepared was cut by means of a diamond knife, to a slice having the thickness of about 0.1 μm. The slice was observed by means of a transmission type electron microscope and twin planes of the tabular grains were confirmed. From a picture obtained by the electron microscopic photography, a twin plane interval (a) and the ratio of the thickness (b) of tabular grain to the twin plane interval (a) (b/a) were measured. Tabular grains having the ratio of (b/a) set forth below, accounted for 81% or more of all the silver halide grains.

$$1.5 \leqq (b/a) < 5$$

The average (b/a) was 4.1. (coefficient of variation=23%)

(Preparation of Emulsion B for Comparison)

Nucleation was carried out in the same manner as the preparation of Emulsion A, except that the aqueous sodium chloride solution (N-1) was replaced by an aqueous sodium chloride solution (M-1) which was the same as the solution (N-1) except for omitting the 2 g of an inert gelatin therefrom. Other preparation subsequent to nucleation until the chemical sensitization was carried out in the same manner as in the preparation of Emulsion A. Among the thus-obtained grains (B), tabular grains having the grain thickness of 0.30 μm or less and the aspect ratio of 2 or more, accounted for 95% or more of the total grain projected area. In addition, the average aspect ratio was 6.5, the average grain thickness was 0.123 μm and the average equivalent circle diameter was 0.80 μm. Tabular grains having the ratio of (b/a) set forth below, accounted for 65% or more of all the silver halide grains.

$$1.5 \leqq (b/a) < 5$$

The average (b/a) was 8.1. (coefficient of variation=33%)

(Preparation of Emulsion C for Comparison)

The Emulsion C was prepared in the same manner preparation up to the chemical sensitization as the preparation of Emulsion A, except that only the 500 ml of a 10% phthalated gelatin aqueous solution (G-1) was added after elevating the temperature to 50° C. over the period of 24 minutes, 1 minute later from completion of adding both the (A-1) solution and the (N-1) solution. Among the thus-obtained grains (C), tabular grains having the grain thickness of 0.30 μm or less and the aspect ratio of 2 or more, accounted for 95% or more of the total grain projected area. In addition, the average aspect ratio was 6.2, the average grain thickness was 0.125 μm and the average equivalent circle diameter was 0.78 μm. Tabular grains having the ratio of (b/a) set forth below, accounted for 62% or more of all the silver halide grains.

$$1.5 \leqq (b/a) < 5$$

The average (b/a) was 8.5. (coefficient of variation=28%)

(Preparation of Emulsion D of This Invention: Iodide Content of 0.4 mole %)

The Emulsion D was prepared in the same manner preparation up to the chemical sensitization as the preparation of Emulsion A, except that the (N-3) solution was replaced by 145 ml of an aqueous solution (N-4) containing 12 mg of yellow prussiate of potash and 19.6 g of sodium chloride and 1.1 g of potassium iodide. Among the thus-obtained grains (D), tabular grains having the grain thickness of 0.30 μm or less and the aspect ratio of 2 or more, accounted for 96% or more of the total grain projected area. In addition, the average aspect ratio was 6.7, the average grain thickness was 0.118 μm and the average equivalent circle diameter was 0.79 μm. Tabular grains having the ratio of (b/a) set forth below, accounted for 82% or more of all the silver halide grains.

$$1.5 \leqq (b/a) < 5$$

The average (b/a) was 4.2. (coefficient of variation=22%) (Iodide content of 0.4 mole %)

(Preparation of Emulsion E of This Invention: Iodide Content of 0.39 mole %, Bromide Content of 1.5 mole %)

The emulsion E was prepared in the same manner preparation up to the chemical sensitization as the preparation of Emulsion D, except that 130 ml of an aqueous silver nitrate solution (A-4) (4.3 g of silver nitrate) and 130 ml of an aqueous potassium bromide solution (N-5) (3 g of potassium bromide) were added, after the addition of both the (A-3) solution and the (A-4) solution. Among the thus-obtained grains (E), tabular grains having the grain thickness of 0.30 μm or less and the aspect ratio of 2 or more, accounted for 97% or more of the total grain projected area. In addition, the average aspect ratio was 6.7, the average grain thickness was 0.119 μm and the average equivalent circle diameter was 0.79 μm. Tabular grains having the ratio of (b/a) set forth below, accounted for 84% or more of all the silver halide grains.

$$1.5 \leqq (b/a) < 5$$

The average (b/a) was 4.3. (coefficient of variation=22%) (Iodide content of 0.39 mole %, Bromide Content of 1.5 mole %)

(Preparation of Emulsion F for Comparison: Bromide Content of 15 mole %)

The Emulsion F was prepared in the same manner preparation up to the chemical sensitization as the preparation of Emulsion A, except that the (N-2) solution was replaced by 530 ml of an aqueous solution (N-6) containing 76.5 g of sodium chloride and 27.4 g of potassium bromide, and further the (N-3) solution was replaced by 145 ml of an aqueous solution (N-7) containing 12 mg of yellow prussiate of potash, 15.7 g of sodium chloride and 8 g of potassium bromide. Among the thus-obtained grains (F), tabular grains having the grain thickness of 0.30 μm or less and the aspect ratio of 2 or more, accounted for 95% or more of the total grain projected area. In addition, the average aspect ratio was 7.4, the average grain thickness was 0.109 μm and the average equivalent circle diameter was 0.81 μm. Tabular grains having the ratio of (b/a) set forth below, accounted for 80% or more of all the silver halide grains.

$$1.5 \leqq (b/a) < 5$$

The average (b/a) was 4.8. (coefficient of variation =27%) (Bromide content of 15 mole %)

(Preparation of Emulsion G of This Invention: Small Size)

1.0 g of sodium chloride and 1.6 g of an inert gelatin were added to 1.2 liter of water in a vessel. To the vessel kept at 25° C., 80 ml of an aqueous silver nitrate solution (A-1)(18 g of silver nitrate) and 80 ml of an aqueous sodium chloride solution (N-1) (6.2 g of sodium chloride) containing 4 g of an inert gelatin were added while stirring over the period of 1 minute by a double jet method. 1 minute later after the completion of addition, 500 ml of an aqueous 10% phthalated gelatin solution (G-1) and 20 ml of an aqueous solution (K-1) containing 1.2 mmole of crystal habit-controlling agent 1 were added. Further, 1 minute later, 2.0 g of sodium chloride was added. Then, the temperature of the reaction vessel was elevated to 50° C. over the period of subsequent 24 minutes. The reaction mixture was ripened at 50° C. for 30 minutes. Further, blue-sensitive spectrally sensitizing dyes A, B and C were added in the total amount of $8\times10^{-4}$ mole, per mole of silver halide, and 4 g of sodium dodecylbenzene sulfonate (DBS) were added. Thereafter, the temperature of the resulting emulsion was elevated to 75° C. and allowed to stand for 30 minutes. A sedimentation washing was carried out at 40° C. for desalting. Thereafter, an optimum chemical sensitization was conducted in the same manner as the Emulsion A. Among the thus-obtained grains (G), tabular grains having the grain thickness of 0.30 μm or less and the aspect ratio of 2 or more, accounted for 96% or more of the total grain projected area. In addition, the average aspect ratio was 4.7, the average grain thickness was 0.058 μm and the average equivalent circle diameter was 0.28 μm. Tabular grains having the ratio of (b/a) set forth below, accounted for 86% or more of all the silver halide grains.

$$1.5 \leqq (b/a) < 5$$

The average (b/a) was 1.9. (coefficient of variation 22%)

Details of the profile of the above emulsions are shown in Table 3.

TABLE 3

| Emulsion | Average Equivalent Circle Diameter (μm) | Average Thickness (μm) | Average Aspect Ratio | Minimum Percentage (%) of Grains having Range of (b/a): 1.5 ≦ (b/a) < 5 In All the Silver Halide Grains | Average (b/a) | Coefficient of Variation (%) of (b/a) | Content of Silver Chloride (%) | Remarks |
|---|---|---|---|---|---|---|---|---|
| Emulsion A | 0.81 | 0.114 | 7.1 | 81 | 4.1 | 23 | 100.0 | This invention |
| Emulsion B | 0.80 | 0.123 | 6.5 | 65 | 8.1 | 33 | 100.0 | Comparative example |
| Emulsion C | 0.78 | 0.125 | 6.2 | 62 | 8.5 | 28 | 100.0 | Comparative example |
| Emulsion D | 0.79 | 0.118 | 6.7 | 82 | 4.2 | 22 | 99.6 | This invention |
| Emulsion E | 0.79 | 0.119 | 6.7 | 84 | 4.3 | 22 | 98.1 | This invention |
| Emulsion F | 0.81 | 0.110 | 7.3 | 80 | 4.8 | 27 | 85.0 | Comparative example |
| Emulsion G | 0.28 | 0.058 | 4.7 | 86 | 1.9 | 22 | 100.0 | This invention |

(Preparation of Light-sensitive Material)

Both surface of a paper support laminated with polyethylene were subjected to corona discharge. A gelatin undercoat layer containing sodium dodecylbenzene sulfonate was coated thereon. Further, photographic constituent layers of the first layer to the seventh layer were coated thereon in this order, to make a silver halide color photographic light-sensitive material, Sample T (101) having the layer structure as set forth below. Coating solutions of each of the photographic constituent layers were prepared in the manner described below. Preparation of First Layer Coating Solution 57 g of a yellow coupler (ExY), 7 g of a color image stabilizer (Cpd-1), 4 g of a color image stabilizer (Cpd-2), 7 g of a color image stabilizer (Cpd-3) and 2 g of a color image stabilizer (Cpd-8) were dissolved in 21 g of a solvent (Solv-1) and 80 ml of ethyl acetate. The resultant solution was added to 220 g of a 23.5% by weight-gelatin aqueous solution containing 4 g of sodium dodecylbenzene sulfonate, and the resultant mixture solution was emulsified and dispersed by means of a high speed stirring emulsifier (Disolver), followed by addition of water, to prepare 900 g of Emulsified dispersion A.

The above-mentioned Emulsion A and the Emulsified dispersion A were mixed and dissolved. A first layer coating solution was prepared so as to have the formula as set forth below. The coating amount of the emulsion is converted into that of silver.

The coating solutions for the second layer to the seventh layer were prepared in the similar manner as that for the first-layer coating solution. As the gelatin hardening agent (hardener) for each layer, 1-oxy-3,5-dichloro-s-triazine sodium salt (H-1) was used. Further, to each layer, were added Ab-1, Ab-2, Ab-3, and Ab-4, so that the total amounts would be 15.0 mg/m$^2$, 60.0 mg/m$^2$, 5.0 mg/m$^2$, and 10.0 mg/m$^2$, respectively.

(H-1) Hardener

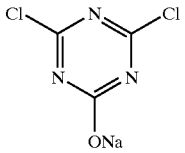

(used in an amount of 1.4 mass % per gelatin)

(H-2) Hardener (HA-25)

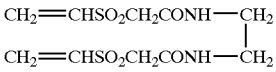

-continued (H-3) Hardener

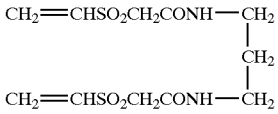

(Ab-1) Antistatic

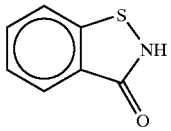

(Ab-2) Antistatic

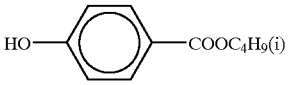

(Ab-3) Antistatic

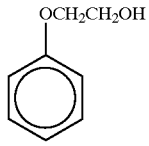

(Ab-4) Antistatic

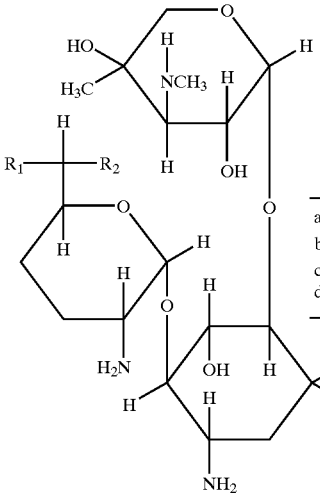

| | $R_1$ | $R_2$ |
|---|---|---|
| a | —$CH_3$ | —$NHCH_3$ |
| b | —$CH_3$ | —$NH_2$ |
| c | —H | —$NH_2$ |
| d | —H | —$NHCH_3$ |

A mixture in 1:1:1:1 (molar ratio) of a, b, c, and d

For the silver chlorobromide emulsions in the green-sensitive and red-sensitive emulsion layers, the following spectral sensitizing dyes were used.

Green-Sensitive Emulsion Layer (Sensitizing dye D)

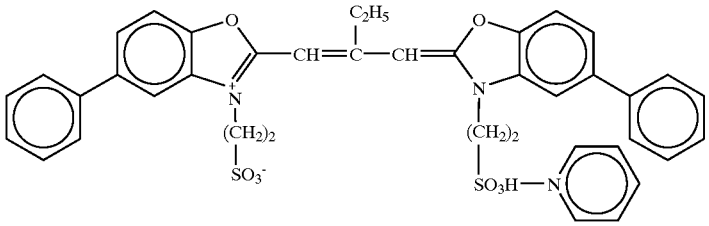

(Sensitizing dye E)

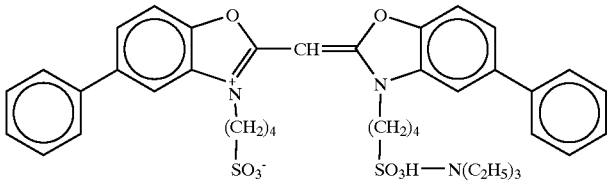

(Sensitizing dye F)

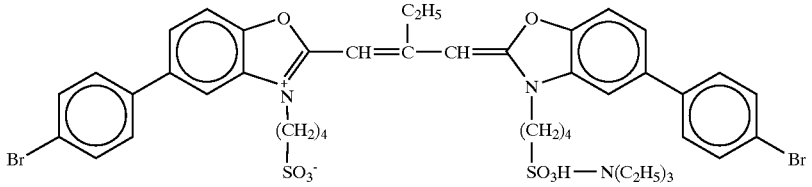

(The sensitizing dye D was added to the large-size emulsion in an amount of 3.0×10 mol, and to the small-size emulsion in an amount of $3.6\times10^{-4}$ mol, per mol of the silver halide; the sensitizing dye E was added to the large-size emulsion in an amount of $4.0\times10^{-5}$ mol, and to the small-size emulsion in an amount of $7.0\times10^{-5}$ mol, per mol of the silver halide; and the sensitizing dye F was added to the large-size emulsion in an amount of $2.0\times10^{-4}$ mol, and to the small-size emulsion in an amount of $2.8\times10^{-4}$ mol, per mol of the silver halide.)

Red-Sensitive Emulsion Layer (Sensitizing dye G)

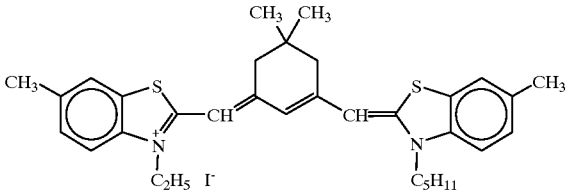

(Sensitizing dye H)

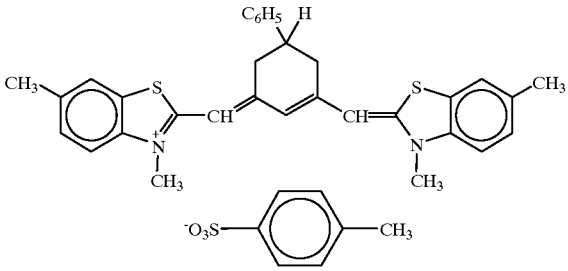

(The sensitizing dyes G and H were added to the large-size emulsion in an amount of 8.0×10 mol, and to the small-size emulsion in an amount of $10.7\times10^{-5}$ mol. per mol of the silver halide.)

Further, the following compound I was added to the red-sensitive emulsion layer in an amount of 3.0×10 mol per mol of the silver halide.

(Compound I)

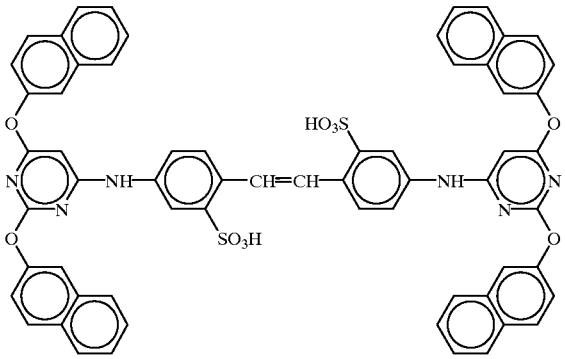

Further, to the green-sensitive emulsion layer and the red-sensitive emulsion layer, was added 1-(3-methylureidophenyl)-5-mercaptotetrazole in amounts of $3.3\times10^{-4}$ mol, $1.0\times10^{-3}$ mol, and $5.9\times10^{-4}$ mol, respectively, per mol of the silver halide.

Further, the compound was also added to the second layer, the forth layer, the sixth layer, and the seventh layer, in amounts of 0.2 mg/m$^2$, 0.2 mg/m$^2$, 0.6 mg/m$^2$, and 0.1 mg/m$^2$, respectively.

Further, to the blue-sensitive emulsion layer and the green-sensitive emulsion layer, were added 4-hydroxy-6-methyl-1,3,3a,7-tetrazaindene in amounts of $1\times10^{-4}$ mol and $2\times10^{-4}$ mol, respectively, per mol of the silver halide.

Further, to the red-sensitive emulsion layer, was added a copolymer latex of methacrylic acid and butyl acrylate (1:1 in weight ratio; average molecular weight, 200,000 to 400,000) in an amount of 0.05 g/m$^2$.

Further, to the second layer, the fourth layer, and the sixth layer, was added disodium catechol-3,5-disulfonate in amounts of 6 mg/m$^2$, 6 mg/m$^2$, and 18 mg/m$^2$, respectively.

Further, in order to prevent irradiation, the following dyes (coating amounts are shown in parentheses) were added.

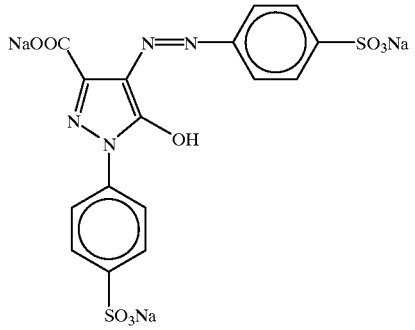

(2mg/m$^2$)

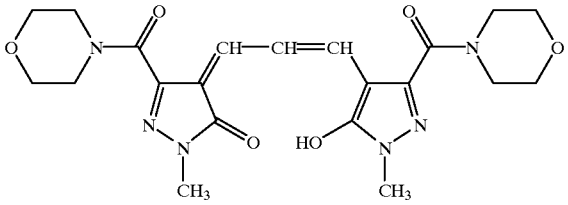

(2mg/m$^2$)

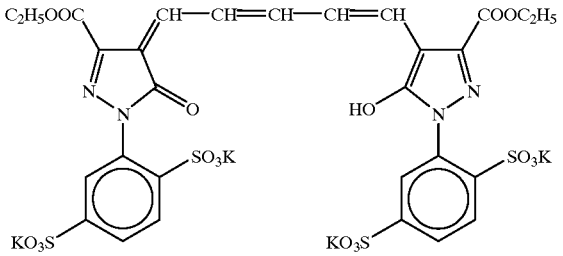

(3mg/m$^2$)

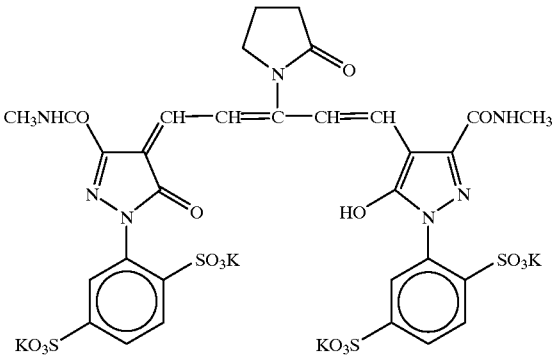

(7mg/m$^2$)

(Layer Structure)

The composition of each layer is shown below. The numbers show coating amounts (g/m$^2$). In the case of the silver halide emulsion, the coating amount is in terms of silver.

Support (Base)

Polyethylene Resin Laminated Paper

[The polyethylene resin on the first layer side contained a white pigment ($TiO_2$; content of 16 wt %, ZnO; content of 4 wt %), a fluorescent whitening agent (4,4'-bis(5-methylbenzoxazolyl)stilbene, content of 0.03 wt %) and a bluish dye (ultramarine)]

| | |
|---|---|
| First Layer (Blue-Sensitive Emulsion Layer) | |
| Emulsion A | 0.24 |
| Gelatin | 1.25 |
| Yellow coupler (ExY) | 0.57 |
| Color-image stabilizer (Cpd-1) | 0.07 |
| Color-image stabilizer (Cpd-2) | 0.04 |
| Color-image stabilizer (Cpd-3) | 0.07 |
| Color-image stabilizer (Cpd-8) | 0.02 |
| Solvent (Solv-1) | 0.21 |
| Second Layer (Color-Mixing Inhibiting Layer) | |
| Gelatin | 0.99 |
| Color-mixing inhibitor (Cpd-4) | 0.09 |
| Color-image stabilizer (Cpd-5) | 0.018 |
| Color-image stabilizer (Cpd-6) | 0.13 |
| Color-image stabilizer (Cpd-7) | 0.01 |
| Solvent (Solv-1) | 0.06 |
| Solvent (Solv-2) | 0.22 |
| Third Layer (Green-Sensitive Emulsion Layer) | |
| A silver chlorobromide emulsion F (cubes a 1:3 mixture of a large-size emulsion H1 having an average size of side length of 0.45 $\mu$m, and a small-size emulsion H2 having an average size of side length of grain of 0.35 $\mu$m (in terms of mol of silver). The deviation coefficients of the grain size distributions were 0.10 and 0.08, respectively. Each emulsion had 0.4 mol % of silver bromide contained locally in part of the grain surface whose substrate was made up of silver chloride) | 0.14 |
| Gelatin | 1.36 |
| Magenta coupler (ExM) | 0.15 |
| Ultraviolet absorbing agent (UV-A) | 0.14 |
| Color-image stabilizer (Cpd-2) | 0.02 |
| Color-image stabilizer (Cpd-4) | 0.002 |
| Color-image stabilizer (Cpd-6) | 0.09 |
| Color-image stabilizer (Cpd-8) | 0.02 |
| Color-image stabilizer (Cpd-9) | 0.03 |
| Color-image stabilizer (Cpd-10) | 0.01 |
| Color-image stabilizer (Cpd-11) | 0.0001 |
| Solvent (Solv-3) | 0.11 |
| Solvent (Solv-4) | 0.22 |
| Solvent (Solv-5) | 0.20 |
| Fourth Layer (Color-Mixing Inhibiting Layer) | |
| Gelatin | 0.71 |
| Color-mixing inhibitor (Cpd-4) | 0.06 |
| Color-image stabilizer (Cpd-5) | 0.013 |
| Color-image stabilizer (Cpd-6) | 0.10 |
| Color-image stabilizer (Cpd-7) | 0.007 |
| Solvent (Solv-1) | 0.04 |
| Solvent (Solv-2) | 0.16 |
| Fifth Layer (Red-Sensitive Emulsion Layer) | |
| A silver chlorobromide emulsion G (cubes, a 5:5 mixture of a large-size emulsion I1 having an average size of side length of grain 0.40 $\mu$m, and a small-size emulsion I2 having an average size of side length of grain of 0.30 $\mu$m (in terms of mol of silver). The deviation coefficients of the grain size distributions were 0.09 and 0.11, respectively. Each emulsion had 0.8 mol % of silver bromide contained locally in part of the grain surface whose substrate was made up of silver chloride) | 0.12 |
| Gelatin | 1.11 |

-continued

| | |
|---|---|
| Cyan coupler (ExC-2) | 0.13 |
| Cyan coupler (ExC-3) | 0.03 |
| Color-image stabilizer (Cpd-1) | 0.05 |
| Color-image stabilizer (Cpd-6) | 0.06 |
| Color-image stabilizer (Cpd-7) | 0.02 |
| Color-image stabilizer (Cpd-9) | 0.04 |
| Color-image stabilizer (Cpd-10) | 0.01 |
| Color-image stabilizer (Cpd-14) | 0.01 |
| Color-image stabilizer (Cpd-15) | 0.12 |
| Color-image stabilizer (Cpd-16) | 0.03 |
| Color-image stabilizer (Cpd-17) | 0.09 |
| Color-image stabilizer (Cpd-18) | 0.07 |
| Solvent (Solv-5) | 0.15 |
| Solvent (Solv-8) | 0.05 |
| Sixth layer (ultraviolet absorbing layer) | |
| Gelatin | 0.46 |
| Ultraviolet absorber (UV-B) | 0.45 |
| Compound (S1-4) | 0.0015 |
| Solvent (Solv-7) | 0.25 |
| Seventh layer (protective layer) | |
| Gelatin | 1.00 |
| Acryl-modified copolymer of polyvinyl alcohol (the degree of modification: 17%) | 0.04 |
| Liquid paraffin | 0.02 |
| Surfactant (Cpd-13) | 0.01 |

(ExY) Yellow coupler

A mixture in 70:30 (molar ratio) of

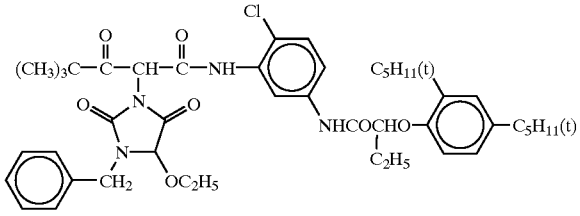

and

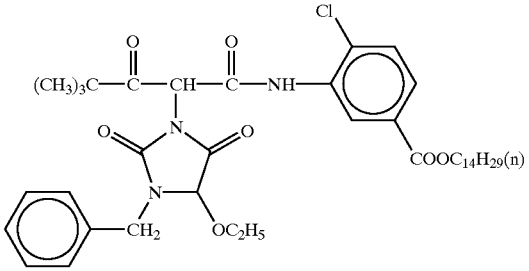

(ExM) Magenta coupler

A mixture in 40:40:20 (molar ratio) of

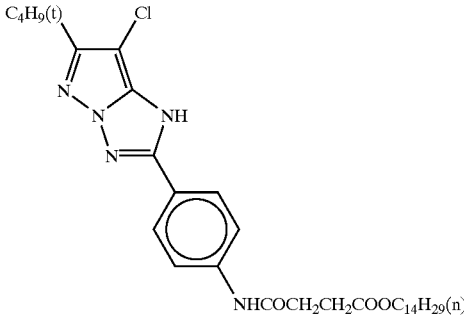

-continued

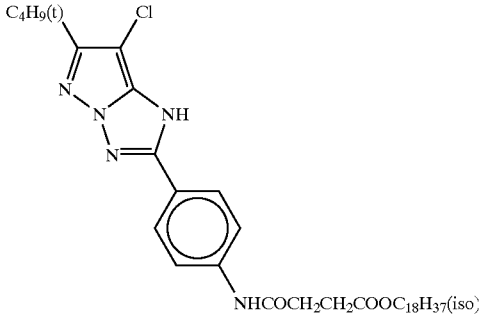

and

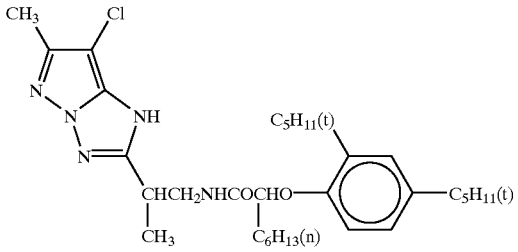

(ExC-2) Cyan coupler

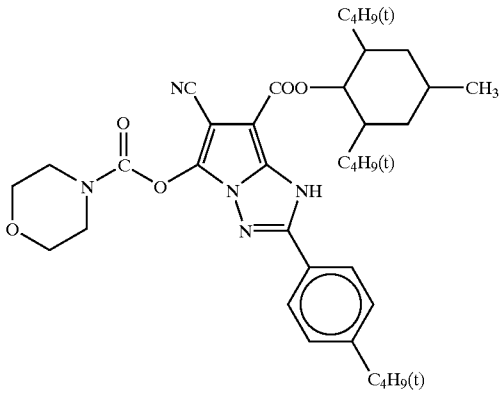

(ExC-3) Cyan coupler

A mixture in 50:25:25 (molar ratio) of

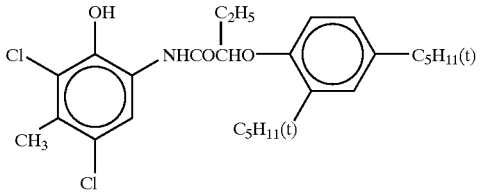

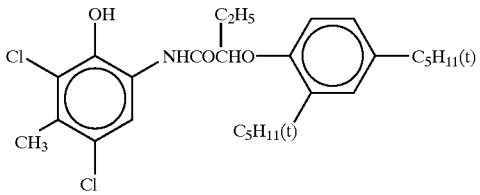

and

-continued

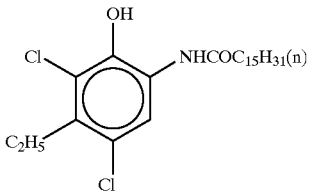

(Cpd-1) Color-image stabilizer

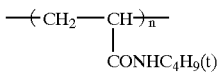

number average
molecular weight 60,000
(Cpd-2) Color-image stabilizer

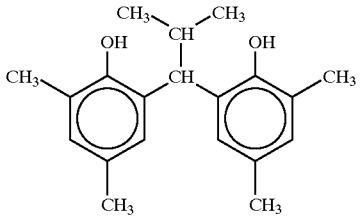

(Cpd-3) Color-image stabilizer

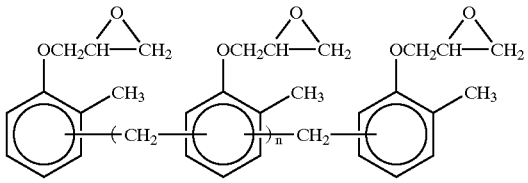

n = 7 ~ 8 (average)
(Cpd-4) Color-mixing inhibitor

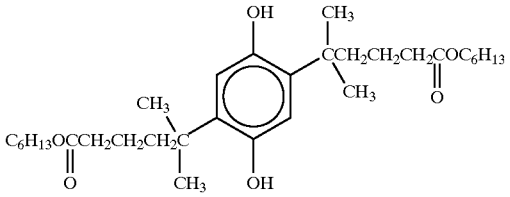

(Cpd-5) Color-image stabilizer

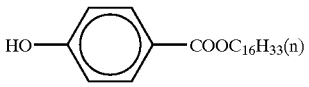

(Cpd-6) Color-image stabilizer

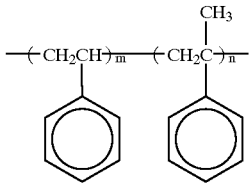

number average
molecular weight 600
m/n = 10/90
(Cpd-7) Color-image stabilizer

-continued

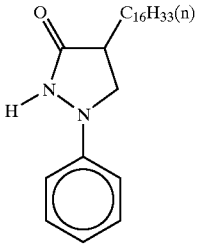

(Cpd-8) Color-image stabilizer

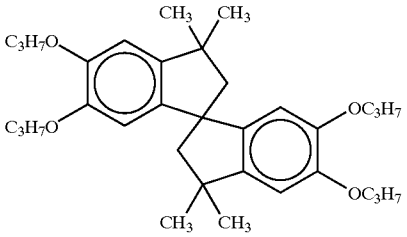

(Cpd-9) Color-image stabilizer

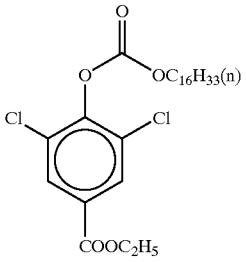

(Cpd-10) Color-image stabilizer

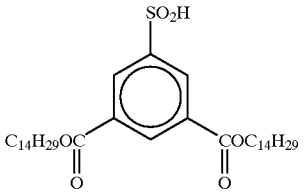

(Cpd-11)

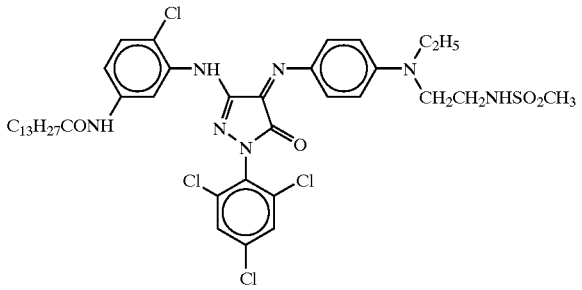

(Cpd-13) Surfactant
A mixture in 7:3 (molar ratio) of

-continued
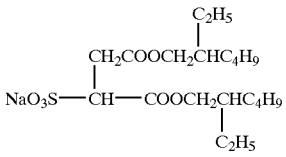
and
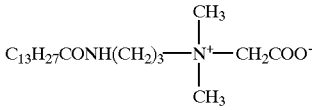
(Cpd-14)
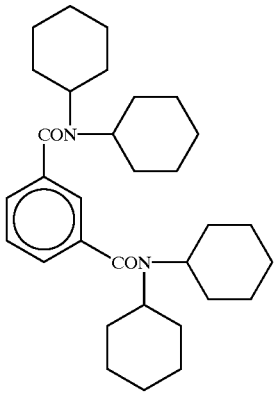
(Cpd-15)
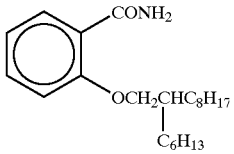
(Cpd-16)
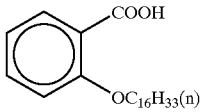
(Cpd-17)
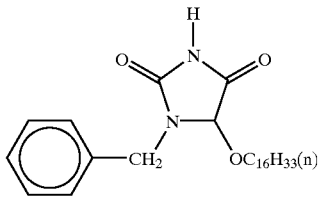
(Cpd-18)
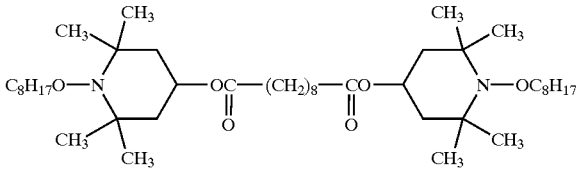
-continued
(Cpd-19) Color-mixing inhibitor
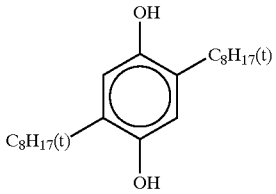
(UV-1) Ultra-violet absorbent
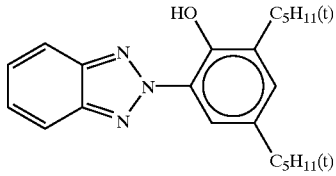
(UV-2) Ultra-violet absorbent
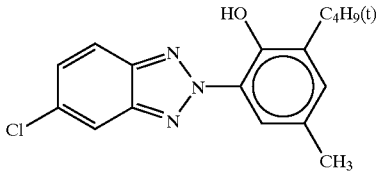
(UV-3) Ultra-violet absorbent
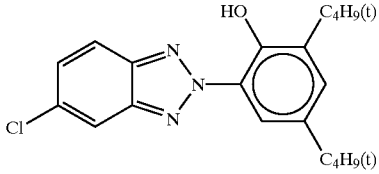
(UV-4) Ultra-violet absorbent
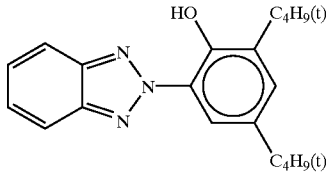
(UV-5) Ultra-violet absorbent
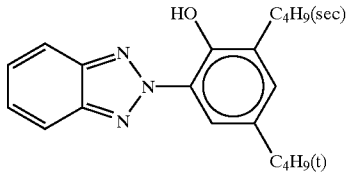
(UV-6) Ultra-violet absorbent
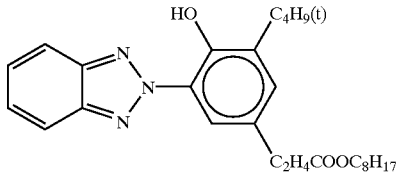

-continued (UV-7)
Ultra-violet absorbent

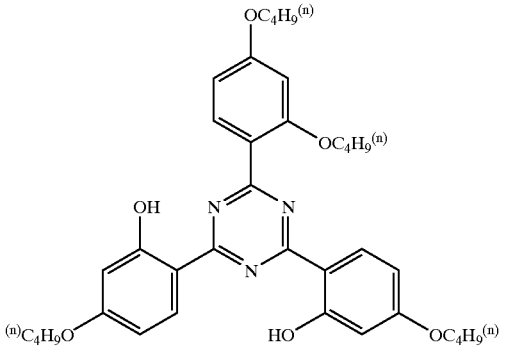

UV-A: a mixture of UV-1/UV-2/UV-3/UV-4 = 4/2/2/3 (weight ratio)
UV-B: a mixture of UV-1/UV-2/UV-3/UV-4/UV-5/UV-6 = 9/3/3/4/5/3 (weight ratio)
UV-C: a mixture of UV-2/UV-3/UV-6/UV-7 = 1/1/1/2 (weight ratio)

(Solv-1)

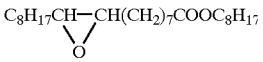

Solv-2

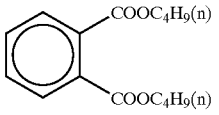

(Solv-3)

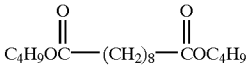

(Solv-4)

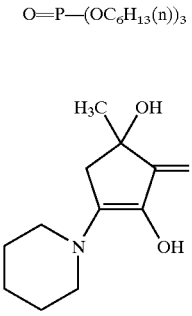

(Solv-5)

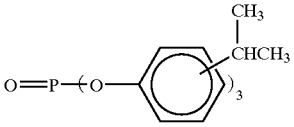

(Solv-7)

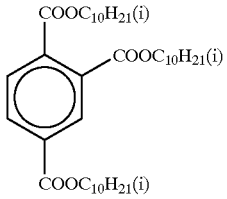

(Solv-8)

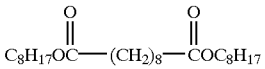

Similarly, Emulsion A of Sample T (110) was replaced by each of Emulsions B, C, D, E, F and G, to prepare coating samples T(120), T(130), T(140), T(150), T(160) and T(170), respectively.

Example 2

In order to evaluate the processing stability of these coating samples, the following tests were carried out.

Test 1

Each coating sample was subjected to low illumination intensity gradation exposure with an optical wedge for sensitometry and a SP-1 filter for 10 seconds, by means of a sensitometer (Model FWH manufactured by Fuji Photo Film Co., Ltd.).

Each of exposed samples was subjected to the color development processing A1, A2, or A3, as set forth below.

The processing steps will be hereinafter explained.

{Processing A1}

The aforementioned light-sensitive material T(110) was made into a roll with a width of 127 mm; the rolled light sensitive material was exposed to light imagewise, using a mini-lab printer processor PP1258AR (trade name) manufactured by Fuji Photo Film Co., Ltd.; and then, the continuous processing (running test) was carried out in the following processing steps, until the replenishment reached to be equal to twice the color development tank volume. The process using the thus-obtained running solutions was designated to as processing A.

| Processing step | Temperature | Time | Replenishment rate* |
|---|---|---|---|
| Color developing | 38.5° C. | 45 sec | 45 ml |
| Bleach-fixing | 38.0° C. | 45 sec | 35 ml |
| Rinse (1) | 38.0° C. | 20 sec | — |
| Rinse (2) | 38.0° C. | 20 sec | — |
| Rinse (3) | **38.0° C. | 20 sec | — |
| Rinse (4) | **38.0° C. | 30 sec | 121 ml |

*Replenishment rate per $m^2$ of the light-sensitive material to be processed.
**A rinse cleaning system RC50D (trade name), manufactured by Fuji Photo Film, Co. Ltd., was installed in the rinse (3) and the rinse solution was taken out from the rinse (3) and sent to a reverse osmosis membrane module (RC50D) by using a pump. The permeated water obtained in that tank was supplied to the rinse (4), and the concentrated water was returned to the rinse (3). Pump pressure was controlled such that the water to be permeated in the reverse osmosis module would be maintained in an amount of 50 to 300 ml/min, and the rinse solution was circulated under controlled temperature for 10 hours a day.
(The rinse was made in a tank counter-current system from (1) to (4).)

The composition of each processing solution was as follows.

| | {Tank solution} | {Replenisher} |
|---|---|---|
| {Color developer} | | |
| Water | 800 ml | 800 ml |
| Dimethylpolysiloxane-series surfactant (Silicone KF351A (trade name)/ Shin-Etsu Chemical Co., Ltd.) | 0.1 g | 0.1 g |
| Tri(isopropanol) amine | 8.8 g | 8.8 g |
| Ethylenediamine tetraacetic acid | 4.0 g | 4.0 g |
| Polyethylene glycol (molecular weight: 300) | 10.0 g | 10.0 g |
| Sodium 4,5-dihydroxybenzene-1,3-disulfonate | 0.5 g | 0.5 g |
| Potassium chloride | 10.0 g | — |
| Potassium bromide | 0.040 g | 0.010 g |
| Triazinylaminostilbene-series fluorescent whitening agent (Hakkol FWA-SF (trade | 2.5 g | 5.0 g |

-continued

| | {Tank solution} | {Replenisher} |
|---|---|---|
| name)/Showa Chemical Industry Co., Ltd.) | | |
| Sodium sulfite | 0.1 g | 0.1 g |
| Disodium-N,N-bis(sulfonatoethyl) hydroxylamine | 8.5 g | 11.1 g |
| N-ethyl-N-(β-methanesulfonamidoethyl)-3-methyl-4-amino-4-aminoaniline · 3/2 sulfuric acid · 1 hydrate | 5.0 g | 15.7 g |
| Potassium carbonate | 26.3 g | 26.3 g |
| Water to make | 1000 ml | 1000 ml |
| pH (25° C./adjusted using potassium hydroxide and sulfuric acid) | 10.15 | 12.50 |
| {Bleach-fixing solution} | | |
| Water | 700 ml | 600 ml |
| Ethylenediamine tetraacetic acid iron (III) ammonium | 47.0 g | 94.0 g |
| Ethylenediamine tetraacetic acid | 1.4 g | 2.8 g |
| m-Carboxybenzenesulfinic acid | 8.3 g | 16.5 g |
| Nitric acid (67%) | 16.5 g | 33.0 g |
| Imidazole | 14.6 g | 29.2 g |
| Ammonium thiosulfate (750 g/l) | 107.0 ml | 214.0 ml |
| Ammonium sulfite | 16.0 g | 32.0 g |
| Ammonium bisulfite | 23.1 g | 46.2 g |
| Water to make | 1000 ml | 1000 ml |
| pH (25° C./adjusted using acetic acid and ammonia) | 6.0 | 6.0 |
| {Rinse solution} | | |
| Sodium chlorinated-isocyanurate | 0.02 g | 0.02 g |
| Deionized water (conductivity: 5 μS/cm or less) | 1000 ml | 1000 ml |
| pH | 6.5 | 6.5 |

{Processing A2}

Further, a processing was carried out in the same manner as in the processing A1, except that the color development processing time was changed from 45 seconds to 120 seconds. The processing is designated to as processing A2.

{Processing A3}

A processing was carried out in the same manner as in the processing A1, except that the bleach-fixing solution was added to the developing solution in the amount of 0.5 ml per liter of the developing solution. The processing is designated to as processing A3.

A yellow color density of each of the samples processed by the foregoing processing A1 to A3 was measured. The minimum color density was defined as a fog. The sensitivity was defined by the reciprocal of an exposing amount required for giving a color density higher by 2.0 than the minimum color density. The sensitivity was represented by a relative value, provided that the sensitivity of sample T (110) processed by the processing A1, is equal to 100. Further, on the characteristic curves obtained by the densitometry, the gradation was measured by the gradient of a straight line connecting the density point used to measure the sensitivity and the density point corresponding to the exposing amount which was higher by 0.5 in terms of log E than the exposing amount used to measure the sensitivity.

{Evaluation 1 of Processing Stability: Test of Dependency on Activities of Developing Solution}

For the evaluation 1 of processing stability, a difference in the fogging density and a fluctuation of gradation between the processing A2 and A1 were compared with respect to each of samples. Specifically, a difference in fogging level and gradation between the 45-second development and the long-time development were compared. In order to evaluate a difference owing to activities of the developing solution, a developing time was changed. The fogging level is represented by the value of (a fogging density in the processing A2 minus a fogging density in the processing A1). The fluctuation of gradation is represented by the ratio of (gradation in the processing A2)/(gradation in the processing A1). The larger the difference in fogging density and the fluctuation of gradation is, the lower the durability is.

{Evaluation 2 of Processing Stability: Test of Dependency on Mixing of Bleach-fixing Solution}

For the evaluation 2 of processing stability, a difference in sensitivity and a fluctuation of gradation between the processing A3 and A1 were compared with respect to each of samples. The difference in sensitivity is measured by comparing the sensitivity in the processing A3 in which the bleach-fixing solution was mixed, to the sensitivity in the processing A1. The fluctuation of gradation is represented by the ratio of (gradation in the processing A3)/(gradation in the processing A1). The larger the difference in sensitivity and the fluctuation of gradation is, the lower the durability is.

The results thus obtained are shown together in Table 4.

TABLE 4

| | | Processing Stability Evaluation 1 Dependency on Activities of Developing Solution | | Processing Stability Evaluation 2 Dependency on Mixing of Bleach-fixing Solution | | |
|---|---|---|---|---|---|---|
| Sample | Relative Sensitivity | Difference in Fogging Density Fogging Density in Processing A2 - Fogging Density in Processing A1 | Fluctuation of Gradation Gradation in Processing A2/Gradation in Processing A1 | Difference in Sensitivity Sensitivity in Processing A3 - Sensitivity in Processing A1 | Fluctuation of Gradation Gradation in Processing A3/Gradation in Processing A1 | Remarks |
| T(110) | 100 | 0.17 | 1.05 | 4.1 | 1.09 | This invention |
| T(120) | 98 | 0.35 | 1.12 | 8.5 | 1.35 | Comparative example |
| T(130) | 97 | 0.32 | 1.09 | 8.4 | 1.31 | Comparative example |
| T(140) | 350 | 0.14 | 1.02 | 3.2 | 1.04 | This invention |
| T(150) | 360 | 0.11 | 1.02 | 3.3 | 1.03 | This invention |
| T(160) | 220 | 0.41 | 1.08 | 19.3 | 1.84 | Comparative example |
| T(170) | 56 | 0.16 | 1.04 | 3.3 | 1.06 | This invention |

As is apparent from Table 4, it was found that the coating samples T (110), T (140), T (150) and T (170) according to the present invention were excellent in both the dependency on activities of the developing solution and the dependency on mixing of the bleach-fixing solution. Particularly, it was found that the coating sample T (140) having a silver iodide content of 0.4 mole %, and moreover the coating samples T (150) having a silver bromide content of 1.5 mole % and a silver iodide content of 0.39 mole % were excellent in durability to a developing solution. On the other hand, it was found that the coating sample T (160) for comparison which contained the Emulsion F having a low silver chloride content (silver bromide content of 15 mole %) was conspicuously large in the difference in fogging density or sensitivity and the fluctuation of gradation determined, in the evaluation of activities of the developing solution or the evaluation of mixing of a blix solution, even though the ratio (b/a) of the coating sample was less than 5.

Example 3

In order to evaluate the rapid-processing stability of these coating samples, the following tests were carried out.

Test 2

Similar to the Test 1, each coating sample was subjected to low illumination intensity gradation exposure with an optical wedge for sensitometry and a SP-1 filter for 10 seconds, by means of a sensitometer (Model FWH manufactured by Fuji Photo Film Co., Ltd.). Each of exposed samples was subjected to the color development processing B1, B2, or B3, as set forth below.

[Processing B1]

The aforementioned light-sensitive material T(110) was made into a roll with a width of 127 mm; the rolled light-sensitive material was exposed to light imagewise, and then, the continuous processing (running test) in the following processing steps was carried out, until the replenishment reached to be equal to twice the color development tank volume. The process using the thus-obtained running solutions was designated to as Processing B1. In that Process B1, use was made of a mini-lab printer processor PP1258AR (trade name), which was manufactured by Fuji Photo Film Co., Ltd. and remodeled so that the conveyer speed could be enhanced in order to shorten the time of the processing steps.

| Processing step | Temperature | Time | Replenishment rate* |
|---|---|---|---|
| Color developing | 45.0° C. | 12 sec | 45 ml |
| Bleach-fixing | 40.0° C. | 12 sec | 35 ml |
| Rinse (1) | 40.0° C. | 4 sec | — |
| Rinse (2) | 40.0° C. | 4 sec | — |
| Rinse (3) | **40.0° C. | 4 sec | — |
| Rinse (4) | **40.0° C. | 4 sec | 121 ml |

*Replenishment rate per $m^2$ of the light-sensitive material to be processed.
**A rinse cleaning system RC50D, manufactured by Fuji Photo Film Co., Ltd., was installed in the rinse (3) and the rinse solution was taken out from the rinse (3) and sent to a reverse osmosis membrane module (RC50D) by using a pump. The permeated water obtained in that tank was supplied to the rinse (4), and the concentrated water was returned to the rinse (3). Pump pressure was controlled such that the water to be permeated in the reverse osmosis module would be maintained in an amount of 50 to 300 ml/min, and the rinse solution was circulated under controlled temperature for 10 hours a day.
(The rinse was made in a tank counter-current system from (1) to (4).)

The composition of each processing solution was as follows.

| | {Tank solution} | {Replenisher} |
|---|---|---|
| {Color developer} | | |
| Water | 800 ml | 800 ml |
| Dimethylpolysiloxane-series surfactant (Silicone KF351A/ Shin-Etsu Chemical Co., Ltd.) | 0.1 g | 0.1 g |
| Tri(isopropanol) amine | 8.8 g | 8.8 g |
| Ethylenediamine tetraacetic acid | 4.0 g | 4.0 g |
| Polyethylene glycol (molecular weight: 300) | 10.0 g | 10.0 g |
| Sodium 4,5-dihydroxybenzene-1,3-disulfonate | 0.5 g | 0.5 g |
| Potassium chloride | 10.0 g | — |
| Potassium bromide | 0.040 g | 0.010 g |
| Triazinylaminostilbene-series fluorescent whitening agent (Hakkol FWA-SF/ Showa Chemical Industry Co., Ltd.) | 2.5 g | 5.0 g |
| Sodium sulfite | 0.1 g | 0.1 g |
| Disodium-N,N-bis(sulfonatoethyl) hydroxylamine | 8.5 g | 11.1 g |
| N-ethyl-N-(β-methanesulfonamidoethyl)-3-methyl-4-amino-4-aminoaniline · 3/2 sulfuric acid · 1 hydrate | 10.0 g | 22.0 g |
| Potassium carbonate | 26.3 g | 26.3 g |
| Water to make | 1000 ml | 1000 ml |
| pH (25° C./adjusted using potassium hydroxide and sulfuric acid) | 10.15 | 12.50 |
| {Bleach-fixing solution} | | |
| Water | 700 ml | 600 ml |
| Ethylenediaminetetraacetic acid iron (III) ammonium | 75.0 g | 150.0 g |
| Ethylenediamine tetraacetic acid | 1.4 g | 2.8 g |
| m-Carboxybenzenesulfinic acid | 8.3 g | 16.5 g |
| Nitric acid (67%) | 16.5 g | 33.0 g |
| Imidazole | 14.6 g | 29.2 g |
| Ammonium thiosulfate (750 g/l) | 107.0 ml | 214.0 ml |
| Ammonium sulfite | 16.0 g | 32.0 g |
| Potassium methabisulfite | 23.1 g | 46.2 g |
| Water to make | 1000 ml | 1000 ml |
| pH (25° C./adjusted using acetic acid and ammonia) | 5.5 | 5.2 |
| {Rinse solution} | | |
| Sodium chlorinated-isocyanurate | 0.02 g | 0.02 g |
| Deionized water (conductivity: 5 μS/cm or less) | 1000 ml | 1000 ml |
| pH | 6.0 | 6.0 |

{Processing B2}

Further, a processing was carried out in the same manner as in the Processing B1, except that the color development processing time was changed from 12 seconds to 40 seconds. The processing is designated as Processing B2.

{Processing B3}

A processing was carried out in the same manner as in the Processing B1, except that the bleach-fixing solution was added to the developing solution in the amount of 0.5 ml per liter of the developing solution. The processing is designated to as Processing B3.

A yellow color density of each of the samples processed by any one of the foregoing processing B1 to B3 was measured in the same manner as in the Example 2. The minimum color density was defined as a fog. The sensitivity was defined by the reciprocal of an exposing amount required for giving a color density higher by 2.0 than the minimum color density. The sensitivity was represented by a relative value, provided that the sensitivity of sample T (110) processed by the processing B1, is equal to 100. Further, on the characteristic curves obtained by the densitometry, the gradation was measured by the gradient of a straight line connecting the density point used to measure the sensitivity and the density point corresponding to the exposing amount which was higher by 0.5 in terms of log E than the exposing amount used to measure the sensitivity.

{Evaluation 3 of Rapid-Processing Stability: Test of Dependency on Activities of Developing Solution}

For the evaluation 3 of rapid processing stability, a difference in the fogging density and a fluctuation of gradation between the processing B2 and B1 were compared with respect to each of samples. A difference in fogging level and gradation between the 12-second development and the long-time development were compared. The fogging level is represented by the value of (a fogging density in the processing B2 minus a fogging density in the processing B1). The fluctuation of gradation is represented by the ratio of (gradation in the processing B2)/(gradation in the processing B1). The larger the difference in fogging density and the fluctuation of gradation is, the lower the durability is.

{Evaluation 4 of Rapid-Processing Stability: Test of Dependency on Mixing of Bleach-fixing Solution}

For the evaluation 4 of rapid-processing stability, a difference in sensitivity and a fluctuation of gradation between the processing B3 and B1 were compared with respect to each of samples. The difference in sensitivity is measured by comparing the sensitivity in the processing B3 in which a bleach-fixing solution was mixed, to the sensitivity in the processing B1. The fluctuation of gradation is represented by the ratio of (gradation in the processing B3)/(gradation in the processing B1). The larger the difference in sensitivity and the fluctuation of gradation is, the lower the durability is.

The results thus obtained are shown together in Table 5.

TABLE 5

| | | Rapid-Processing Stability Evaluation 3 Dependency on Activities of Developing Solution | | Rapid-Processing Stability Evaluation 4 Dependency on Mixing of Bleach-fixing Solution | | |
|---|---|---|---|---|---|---|
| Sample | Relative Sensitivity | Difference in Fogging Density Fogging Density in Processing B2 Fogging Density in Processing B1 | Fluctuation of Gradation Gradation in Processing B2/ Gradation in Processing B1 | Difference in Sensitivity Sensitivity in Processing B3 - Sensitivity in Processing B1 | Fluctuation of Gradation Gradation in Processing B3/ Gradation in Processing B1 | Remarks |
| T(110) | 100 | 0.08 | 1.04 | 2.5 | 1.04 | This invention |
| T(120) | 97 | 0.18 | 1.11 | 6.6 | 1.12 | Comparative example |
| T(130) | 96 | 0.17 | 1.13 | 6.7 | 1.09 | Comparative example |
| T(140) | 360 | 0.05 | 1.02 | 1.9 | 1.02 | This invention |
| T(150) | 355 | 0.04 | 1.01 | 1.8 | 1.02 | This invention |
| T(160) | 210 | 0.43 | 1.34 | 23.1 | 1.21 | Comparative example |
| T(170) | 62 | 0.11 | 1.02 | 2.6 | 1.03 | This invention |

As is apparent from Table 5, it is understood that the coating samples containing the silver halide emulsion of the present invention were also excellent in the processing stability even in the rapid processing system. Particularly, it was found that the coating sample T (140) having a silver iodide content of 0.4 mole %, and moreover the coating samples T (150) having a silver bromide content of 1.5 mole % and a silver iodide content of 0.39 mole % were excellent in durability to a developing solution in the rapid processing system.

Example 4

Samples T (110) to T (170) were subjected to a laser scanning exposure, to form an image.

As the laser light source, 473 nm taken out by converting the wavelength of a YAG solid state laser (the emitting wavelength: 946 nm), using, as an excitation light source, a semiconductor laser GaAlAs (the emitting wavelength: 808.5 nm), by a SHG crystal of $LiNbO_3$ having an inversion domain structure; and 532 nm taken out by converting the wavelength of a $YVO_4$ solid state laser (the emitting wavelength: 1064 nm), using as an excitation light source, a semiconductor laser GaAlAs (the emitting wavelength: 808.7 nm), by a SHG crystal of $LiNbO_3$ having an inversion domain structure; and AlGaInP (the emitting wavelength: about 680 nm; Type No. LN9R20 manufactured by Matsushita Electric Industrial Co., Ltd.), were used. The scanning exposure was conducted in such a manner that each of three color laser beams could move in the direction vertical to the scanning direction by the reflection to a rotating polyhedrons, and successively scan a sample. The temperature of the semiconductor laser was kept constant by using a Peltier device to prevent the lumination from being changed by the temperature. An effective beam diameter was 80 cm. The scanning pitch was 42.3 $\mu$m (600 dpi) and the average exposure time per pixel was $1.7\times10^{-7}$ sec.

After exposure, samples T (110) to T (170) were subjected to a color-development processing using the processing A1 to A3 and B1 to B3. As a result of the same evaluation as in Examples 2 and 3, it was found that with respect to the samples according to the present invention, when a laser scanning exposure was applied, a further excellent processing stability could be obtained, compared to the application of an ordinary exposure. That is, a difference in fogging density and a fluctuation of gradation were smaller in the evaluation 1 of dependency on activities of the developing solution, and a difference in sensitivity and a fluctuation of gradation were smaller in the evaluation 2 of dependency on mixing of the bleach-fixing solution. Consequently, it was found that the light-sensitive material of the present invention, when exposed to a higher illumination intensity light, provided greater advantages.

Having described our invention as related to the present embodiments, it is our intention that the invention not be limited by any of the details of the description, unless otherwise specified, but rather be construed broadly within its spirit and scope as set out in the accompanying claims.

What I claim is:

1. A silver halide emulsion comprising silver halide grains having a silver chloride content of at least 90 mole %, wherein tabular grains satisfying the following conditions (1) and (2) account for at least 70% of the total projected area of all the silver halide grains present:

(1) the grain has {111} major faces, an aspect ratio of 2 or more and a thickness of 0.30 $\mu$m or less, and (2) a ratio (b/a) of the grain thickness (b) to the longest distance (a) between at least two parallel adjacent twin planes of the tabular grain is in the following range;

$$1.5 \leqq (b/a) < 5.$$

2. The silver halide emulsion as claimed in claim 1, wherein the silver halide grains have a silver iodide content of 0.05 to 1.0 mole %.

3. The silver halide emulsion as claimed in claim 1, wherein the silver halide grains have a silver bromide content of 0.05 to 5.0 mole %.

4. The silver halide emulsion as claimed in claim 3, wherein the silver halide grains have a silver iodide content of 0.05 to 1.0 mole %.

5. The silver halide emulsion as claimed in claim 1, wherein a coefficient of variation of the thickness (b) of the grains is 30% or less, wherein a coefficient of variation of the twin plane interval (a) is 30% or less, and wherein a coefficient of variation of the ratio (b/a) is in the range of 30% to 0%.

6. A silver halide color photographic light-sensitive material comprising at least one silver halide emulsion layer which contains the silver halide emulsion as claimed in claim 1.

7. The silver halide color photographic light-sensitive material as claimed in claim 6, wherein in the silver halide emulsion, the silver halide grains have a silver iodide content of 0.05 to 1.0 mole %.

8. The silver halide color photographic light-sensitive material as claimed in claim 6, wherein in the silver halide emulsion, the silver halide grains have a silver bromide content of 0.05 to 5.0 mole %.

9. The silver halide color photographic light-sensitive material as claimed in claim 8, wherein in the silver halide emulsion, the silver halide grains have a silver iodide content of 0.05 to 1.0 mole %.

10. The silver halide color photographic light-sensitive material as claimed in claim 6, wherein the at least one silver halide emulsion layer is selected from a group of a silver halide emulsion layer containing a yellow dye-forming coupler.

11. The silver halide color photographic light-sensitive material as claimed in claim 6, wherein the at least one silver halide emulsion layer containing a yellow dye-forming coupler is positioned most apart from the support than the other silver halide emulsion layers.

12. A method of forming a color image comprising (1) subjecting the silver halide color photographic light-sensitive material of claim 6 to scanning exposure with a light beam modulated based on an image information, and (2) subjecting the exposed light-sensitive material to photoprocessing.

13. The method as claimed in claim 12, wherein the scanning exposure is conducted with a laser light.

14. The method as claimed in claim 12, wherein an exposure time for scanning exposure is $10^{-4}$ sec or less.

15. A method of forming a color image comprising processing the silver halide color photographic light-sensitive material of claim 6 with a color-development processing time of 20 sec or less.

16. The method as claimed in claim 15, wherein a bleach-fixing time is 30 sec or less, and wherein a washing or stabilizing time is 40 sec or less.

17. The silver halide emulsion as claimed in claim 1, wherein the coefficient of variation of the ratio (b/a) is 30% or less.

18. The silver halide emulsion as claimed in claim 1, wherein the tabular grains have a core/shell structure, and a silver iodide content is higher in the shell portion than in the core portion.

19. The silver halide emulsion as claimed in claim 1, wherein the tabular grains have a core/shell structure, and a silver bromide content is higher in the shell portion than in the core portion.

20. The silver halide emulsion as claimed in claim 1, wherein the tabular grains have a core/shell structure, and both a silver iodide content and a silver bromide content are higher in the shell portion than in the core portion.

21. The silver halide emulsion as claimed in claim 1, wherein the tabular grains that have {111} major faces, an aspect ratio of 2 or more and a thickness of 0.03 $\mu$m or less, account for 90% or more of the total projected area of all the silver halide grains present.

22. The silver halide emulsion as claimed in claim 21, wherein the tabular grains satisfying the conditions (1) and (2) account for 80% or more of the total projected area of all the silver halide grains present.

* * * * *